US006873319B2

(12) United States Patent
Inoue et al.

(10) Patent No.: US 6,873,319 B2
(45) Date of Patent: Mar. 29, 2005

(54) METHOD FOR DRIVING ELECTROOPTICAL DEVICE, DRIVING CIRCUIT, AND ELECTROOPTICAL DEVICE, AND ELECTRONIC APPARATUS

(75) Inventors: Akira Inoue, Shiojiri (JP); Akihiko Ito, Tatsuno-cho (JP); Ryo Ishii, Matsumoto (JP); Suguru Yamazaki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 132 days.

(21) Appl. No.: 09/937,966

(22) PCT Filed: Jan. 26, 2001

(86) PCT No.: PCT/JP01/00560

§ 371 (c)(1),
(2), (4) Date: Oct. 2, 2001

(87) PCT Pub. No.: WO01/57837

PCT Pub. Date: Aug. 9, 2001

(65) Prior Publication Data

US 2002/0154104 A1 Oct. 24, 2002

(30) Foreign Application Priority Data

Feb. 2, 2000 (JP) ..... 2000-025716

(51) Int. Cl.[7] ..... G09G 5/00
(52) U.S. Cl. ..... 345/204; 345/98
(58) Field of Search ..... 345/87, 90, 92, 345/93, 94, 95, 96, 98, 99, 100, 207, 208, 214

(56) References Cited

U.S. PATENT DOCUMENTS 5,604,510 A * 2/1997 Blanchard ..... 345/98
5,844,535 A * 12/1998 Itoh et al. ..... 345/92
6,281,868 B1 * 8/2001 Takeuchi et al. ..... 345/90

FOREIGN PATENT DOCUMENTS

| | | |
|---|---|---|
| JP | A 4-186282 | 7/1992 |
| JP | A 5-35202 | 2/1993 |
| JP | 05-035202 | 2/1993 |
| JP | A 5-173508 | 7/1993 |
| JP | 05-173708 | 7/1993 |
| JP | A 6-160893 | 6/1994 |
| JP | A 8-29751 | 2/1996 |
| JP | 08-029751 | 2/1996 |
| JP | A 11-326957 | 11/1999 |

* cited by examiner

*Primary Examiner*—Bipin Shalwala
*Assistant Examiner*—Mansour M. Said
(74) *Attorney, Agent, or Firm*—Oliff & Berridge, PLC

(57) ABSTRACT

The invention provides an electro-optical device capable of a high-quality and high-definition tone display, a driving method thereof, a driving circuit thereof, and electronic equipment using the same. With the invention, one field is divided into a plurality of sub-fields, such that each pixel is turned on or off in each of the sub-fields so that the proportion of the period during which each pixel is turned on to the period during which the associated pixel is turned off within the one field corresponds to the proportion according to the tone data. Further, when each pixel is turned on, either a first voltage which is higher than a constant reference voltage applied to a counter electrode or a second voltage which is lower than the reference voltage is applied to a pixel electrode of the associated pixel, and when the pixel is turned off, a voltage equal to the reference voltage is applied to the pixel electrode of the pixel.

5 Claims, 18 Drawing Sheets

| TONE DATA | Ds | | | | | | |
|---|---|---|---|---|---|---|---|
| | Sf1 | Sf2 | Sf3 | Sf4 | Sf5 | Sf6 | Sf7 |
| (000) | L | L | L | L | L | L | L |
| (001) | H | L | L | L | L | L | L |
| (010) | H | H | L | L | L | L | L |
| (011) | H | H | H | L | L | L | L |
| (100) | H | H | H | H | L | L | L |
| (101) | H | H | H | H | H | L | L |
| (110) | H | H | H | H | H | H | L |
| (111) | H | H | H | H | H | H | H |

| FR | Ln | dn |
|---|---|---|
| H | H | Vs1 |
| L | H | Vs2 |
| * | L | Vc |
FIG. 5
(a)
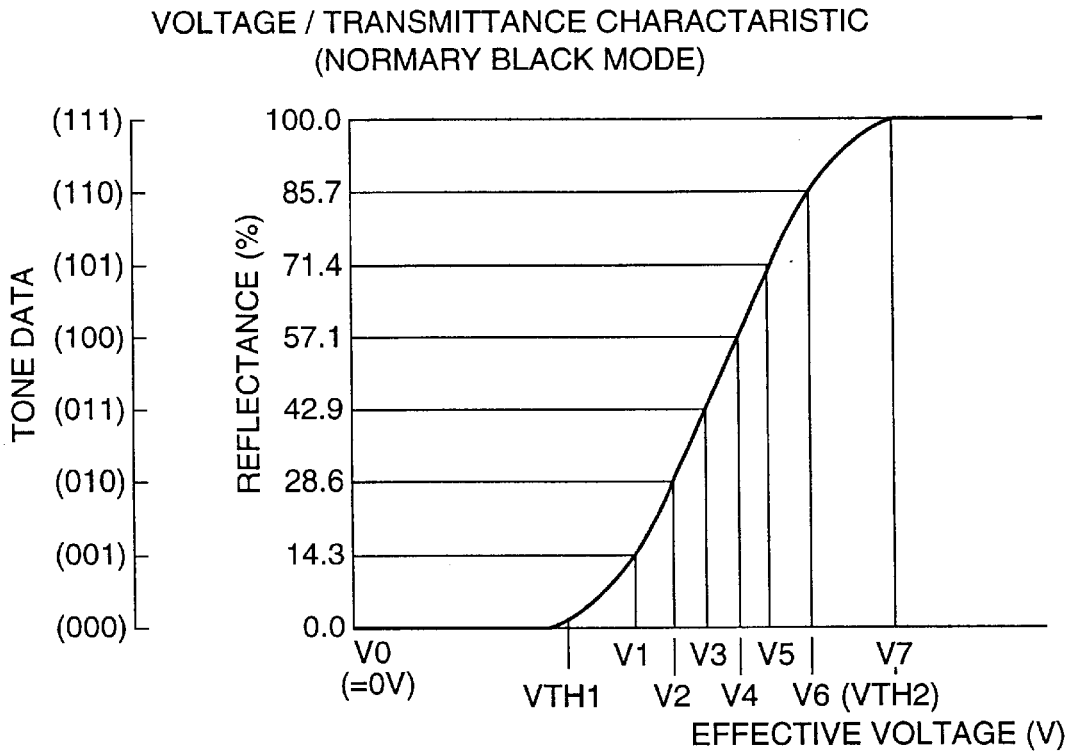
(b)
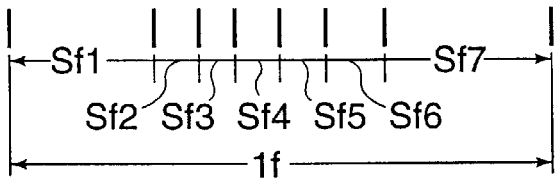
FIG. 6

(a)

(b)

(c)

| FR1 OR FR2 | Ln | dn |
|---|---|---|
| H | H | Vs1 |
| L | H | Vs2 |
| * | L | Vc |

FIG. 15

METHOD FOR DRIVING ELECTROOPTICAL DEVICE, DRIVING CIRCUIT, AND ELECTROOPTICAL DEVICE, AND ELECTRONIC APPARATUS

BACKGROUND OF THE INVENTION

1. Field of Invention

The present invention relates to a driving method and a driving circuit of an electro-optical device that performs a tone display control by modulation on the time axis and an electro-optical device and electronic equipment.

2. Description of Related Art

Electro-optical devices, such as liquid crystal display devices using liquid crystal as an electro-optical material, are widely used in display units of various information processors, liquid crystal television sets and the like as display devices. Such devices are taking the place of cathode-ray tubes (CRTs).

For example, a conventional electro-optical device includes pixel electrodes which are arranged into a matrix, an element substrate having switching elements such as TFTs (thin film transistors) coupled to the pixel electrodes, an opposing substrate on which counter electrodes which oppose the pixel electrodes are formed, and a liquid crystal serving as an electro-optical material which is filled between both substrates. In such a structure, when scanning signals are applied to the switching elements through scanning lines, the switching elements conduct. While the switching elements are conducting, when image signals of voltages according to the desired tone are applied to the pixel electrodes through data lines, electrical charge according to the voltages of the image signals accumulates in the liquid crystal layer formed between the pixel electrodes and the counter electrodes. Once the electrical charge has accumulated, the accumulation of electrical charge in the liquid crystal layer is maintained due to the liquid crystal layer's own capacitance or the accumulated capacitance even if the switching elements are turned off. When the switching elements are driven to control the amount of accumulated charge according to the desired tone in this way, the orientation of the liquid crystal varies from pixel to pixel, and the density varies from pixel to pixel. A tone display is therefore possible.

The electrical charge may accumulate in the liquid crystal layer of the pixels for only a portion of a period. Hence, the process to, first, use a scanning line driving circuit to sequentially select the scanning lines, second, use a data line driving circuit to sequentially select the data lines for a period during which the scanning lines are selected, and, third, sample the image signals of voltages according to the desired tone for the selected data lines enables time-divisional multiplex driving in which the scanning lines and the data lines are commonly used by a plurality of pixels.

However, the image signals applied to the data lines refer to voltages according to the desired tone, namely, analog signals. This requires a D/A converting circuit, an operational amplifier, etc. as peripheral circuits of the electro-optical device, leading to increased cost of the overall device. Furthermore, since a nonuniform display can be caused by nonuniformity in characteristics of the D/A converting circuit, the operational amplifier, etc., various wiring resistances, etc., there is a problem in that it is extremely difficult to achieve a high-quality display. This problem is noticeable in particular when a high-definition display is desired.

SUMMARY OF THE INVENTION

The present invention has been made in view of the foregoing circumstances, and provides an electro-optical device capable of a high-quality and high-definition tone display, a driving method thereof, a driving circuit thereof, and electronic equipment using the electro-optical device.

In order to achieve the above-described object, a first embodiment of the present invention provides a driving method of an electro-optical device for driving a plurality of pixels having pixel electrodes so as to be turned on or off according to tone data, the pixels being disposed at intersections between a plurality of data lines and a plurality of scanning lines. The driving method includes applying a constant reference voltage to counter electrodes which oppose the pixels, dividing one field into a plurality of sub-fields, such that a given pixel is turned on or off in each of the sub-fields so that the proportion of the period during which the pixel is turned on to the period during which the pixel is turned off within the one field corresponds to the proportion according to the tone data, and when the pixel is turned on, switching any one of a first voltage which is higher than the reference voltage and a second voltage which is lower than the reference voltage at a predetermined time interval to apply it to the pixel electrode of the pixel.

According to the first embodiment, in one field, the period during which a pixel is turned on (or off) is pulse-width modulated according to the tone of that pixel, resulting in a tone display using an effective voltage control. In this case, in each of the sub-fields, a binary signal (that is, a digital signal which can only take either of a H-level or L-level) which indicates that the pixel is turned on or off is used to select any one of a first voltage, a second voltage, and a voltage equal to the reference voltage. This suppresses nonuniform display caused by nonuniformity in component characteristics, wiring resistance, etc., and as a result, a high-quality and high-definition tone display is achieved.

Furthermore, according to the first embodiment, when a given pixel is turned on, the voltage applied to the pixel electrode of that pixel is switched at a predetermined time interval to be a first voltage, a second voltage having polarity opposite to that of the first voltage using the reference voltage as a reference. This can avoid a DC component from being applied to the liquid crystal layer which is an electro-optical material layer. As a result, advantageously, degradation in the liquid crystal can be suppressed.

Furthermore, according to the first embodiment, the first voltage and the second voltage may be applied to one pixel and another pixel which are adjacent to each other and which are connected to the same scanning line, as voltages to turn on the pixels. With this structure, advantageously, a switching current which is produced when the voltage is applied to the data lines can be less affected on peripheral circuits, and the power consumption can be reduced.

Second embodiment of the invention also provides a driving circuit of an electro-optical device for driving a plurality of pixels, having pixel electrodes and counter electrodes opposing the pixel electrodes and to which a constant reference voltage is applied, so as to be turned on or off according to tone data, the pixels being disposed at intersections between a plurality of data lines and a plurality of scanning lines. The driving circuit includes a data converting circuit for generating a binary signal indicating that a given pixel is turned on or off in each of a plurality of sub-fields divided from each field, the data converting circuit generating the binary signal from the tone data in each sub-field per pixel so that the proportion of the period during which the pixel is turned on to the period during which the pixel is turned off within one field corresponds to the proportion according to the tone data, and a data line driving circuit for applying a voltage to turn on or off the pixel to the data lines according to the binary signal from the data converting circuit, and, when the pixel is turned on, for switching any one of a first voltage which is higher than the reference voltage and a second voltage which is lower than the reference voltage at a predetermined time interval to apply it to the data line to which the pixel is connected.

The second embodiment of the invention implements the above-described first embodiment as a driving circuit of an electro-optical device, and has the same advantages as those of the first embodiment.

In this second embodiment, the data line driving circuit may apply first voltage and the second voltage via the data lines to one pixel and another pixel, respectively, which are adjacent to each other and which are connected to the same scanning line, as voltages to turn on the pixels. By doing so, advantageously, a switching current which is produced when the voltage is applied to the data lines can be less affected on peripheral circuits, and the power consumption can be reduced.

Furthermore, in the second embodiment, each of the plurality of scanning lines is constituted by a first scanning line and a second scanning line. The circuit may further include a scanning line driving circuit for supplying a first scanning signal to the first scanning line and a second scanning signal, having a signal polarity opposite to the first scanning signal, to the second scanning line, the pixels being connected to the data lines via complementary switching elements connected to the first scanning line and the second scanning line. By doing so, advantageously, the levels of the scanning signals can be reduced regardless of the threshold voltage of the switching elements, and the power consumption can be thus reduced.

Furthermore, the voltage level at which the first scanning signal allows the switching element connected to the first scanning line to be turned on and the voltage level of the first voltage may be the same, and the voltage level at which the second scanning signal allows the switching element connected to the second scanning line to be turned on and the voltage level of the second voltage may be the same. Then, advantageously, the number of levels of the voltages used in the driving circuit of the electro-optical device can be reduced, thus providing simplification of the structure of circuit to generate the voltages.

A third embodiment of the invention provides an electro-optical device that can include a plurality of pixels having pixel electrodes, which are disposed at intersections between a plurality of data lines and a plurality of scanning lines, counter electrodes opposing the pixel electrodes and to which a constant reference voltage is applied, a data converting circuit for generating a binary signal indicating to apply either voltage to turn on or off a given pixel in each of a plurality of sub-fields divided from each field, the data converting circuit generating the binary signal from tone data in each sub-field per pixel so that the proportion of the period during which the pixel is turned on to the period during which the pixel is turned off within one field corresponds to the proportion according to the tone data, and a data line driving circuit for applying a voltage to turn on or off the pixel to the data lines according to the binary signal from the data converting circuit, and, when a pixel is turned on, for switching any one of a first voltage which is higher than the reference voltage and a second voltage which is lower than the reference voltage at a predetermined time interval to apply it to the data line to which the pixel is connected.

This third embodiment implements the above-described first invention as an electro-optical device, and has the same advantages as those of the first invention.

Also in the third embodiment, the data line driving circuit may apply the first voltage and the second voltage via the data lines to one pixel and another pixel, respectively, which are adjacent to each other and which are connected to the same scanning line, as voltages to turn on the pixels. By doing so, advantageously, a switching current which is produced when the voltage is applied to the data lines can be less affected on peripheral circuits, and the power consumption can be reduced.

Furthermore, in the third embodiment, each of the plurality of scanning lines is constituted by a first scanning line and a second scanning line, and the device may further include a scanning line driving circuit for supplying a first scanning signal to the first scanning line and a second scanning signal, having a signal polarity opposite to the first scanning signal, to the second scanning line, the pixels being connected to the data lines via complementary switching elements connected to the first scanning line and the second scanning line. By doing so, advantageously, the levels of the scanning signals can be reduced regardless of the threshold voltage of the switching elements, and the power consumption can be thus reduced.

Furthermore, the voltage level at which the first scanning signal allows the switching element connected to the first scanning line to be turned on and the voltage level of the first voltage is the same, and the voltage level at which the second scanning signal allows the switching element connected to the second scanning line to be turned on and the voltage level of the second voltage is the same, thereby advantageously, reducing the number of levels of the voltages used in the driving circuit of the electro-optical device, and thus providing simplification of the structure of circuit to generate the voltages.

The present invention can be implemented in an aspect in which the electro-optical device is solely manufactured or sold, as well as in an aspect in which electronic equipment having this electro-optical device as a display is manufactured or sold.

BRIEF DESCRIPTION OF THE DRAWINGS

The invention is described in detail with reference to the following figures, wherein like numerals reference like elements, and wherein:

FIG. 5 shows a truth table which illustrates the functionality of a data converting circuit in the electro-optical device;

FIG. 6(*a*) is a view illustrating the voltage/transmittance characteristic of the liquid crystal, and FIG. 6(*b*) is a view showing the state of sub-fields in one field;

FIG. 15 shows a truth which illustrates the functionality of a multiplexer in the data line driving circuit;

DETAILED DESCRIPTION OF PREFERRED EMBODIMENTS

Figure 1:
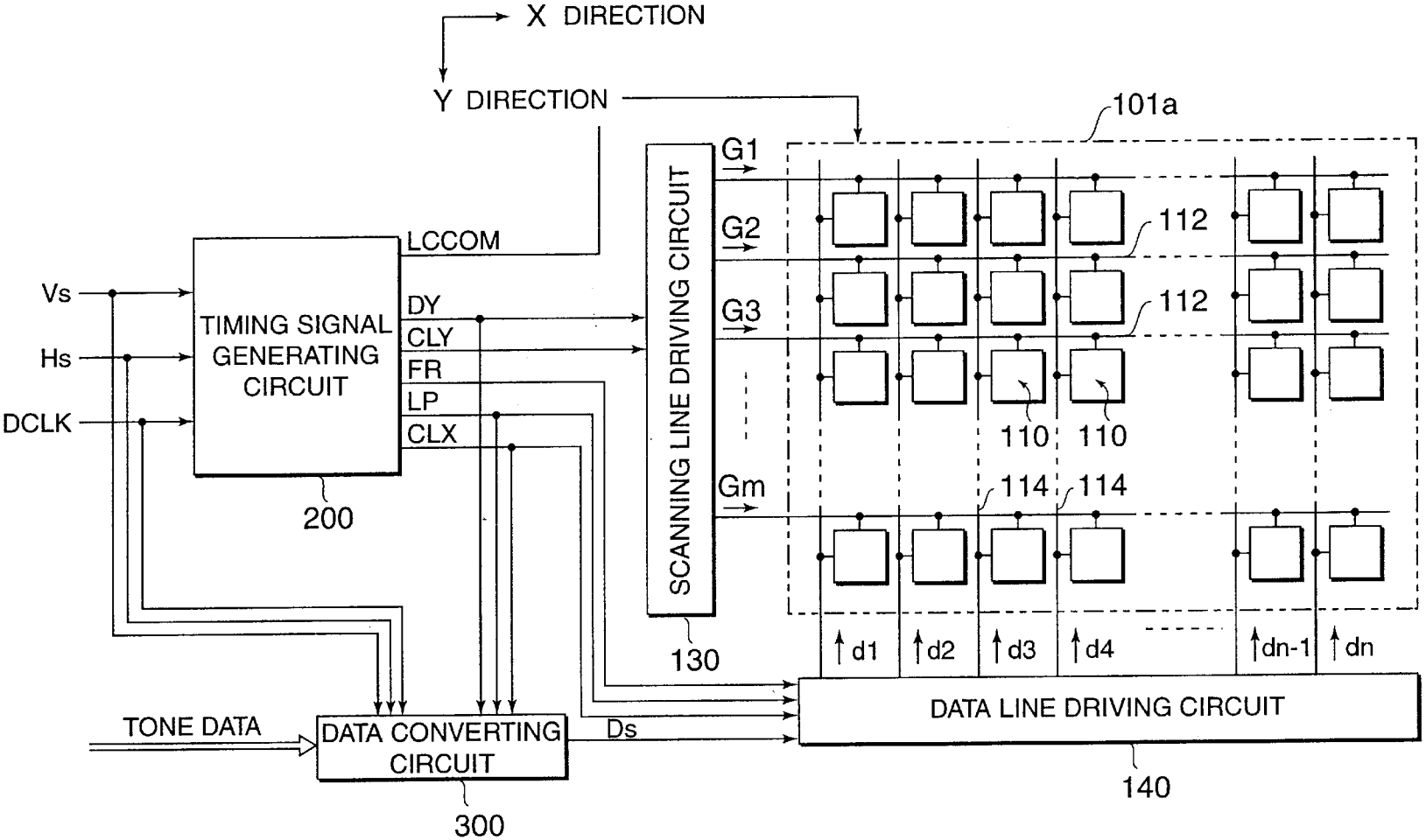
FIG. 1 is an exemplary block diagram of the structure of an electro-optical device according to a first embodiment of the present invention.

For clarification of understanding of an apparatus according to the present invention, first, a driving method of an electro-optical device according to the present embodiment is described. In general, in a liquid crystal device using a liquid crystal which embodies an electro-optical device, the relationship between the effective voltage applied to the liquid crystal and the relative transmittance (or reflectance) is as shown in FIG. 6(*a*) taking a normally black mode as an example in which black display is performed while no voltage is applied. As used herein, the relative transmittance (or reflectance) is such that the minimum value and the maximum value of the amount of transmitted light are normalized to 0% and 100%, respectively. As shown in FIG. 6(*a*), the transmittance of the liquid crystal is 0% when the voltage applied to the liquid crystal layer is smaller than a threshold value VTH1, while it increases nonlinearly in proportion to the applied voltage when the applied voltage is greater than or equal to the threshold value VTH1 and is less than or equal to a saturating voltage VTH2. When the applied voltage is greater than or equal to the saturating voltage VTH2, the transmittance of the liquid crystal is maintained constant regardless of the applied voltage.

For the purposes of this disclosure, it is assumed that the electro-optical device according to the present embodiment provides an eight-level tone display with 3-bit tone data each indicating the transmittance shown in the same figure. However, it is to be understood that more or less may be provided. In this case, if the voltages applied to the liquid crystal layer according to the transmittances are represented by V0 to V7, respectively, it is arranged in the prior art that the voltages V0 to V7 are applied to the liquid crystal layer. Therefore, in particular, the voltages V1 to V6 corresponding to the intermediate tone are susceptible to variations in characteristics of analog circuits such as a D/A converting circuit and an operational amplifier or various wiring resistances, which easily results in nonuniform pixels, and a high-quality and high-definition tone display is thus difficult.

Accordingly, the electro-optical device according to the present embodiment drives the pixels in the following way. As used herein, one field indicates a time required to form one raster image by horizontal scanning and vertical scanning in synchronization with horizontal scanning signals and vertical scanning signals. Therefore, one field as defined in the present invention also encompasses one frame used in the non-interlace type.

First, according to the present embodiment, a voltage which is instantaneously applied to the liquid crystal layer is either an L-level voltage VL (=0) or an H-level voltage VH, by way of example. If the voltage VL is applied to the liquid crystal layer throughout a period of one field (1f), a transmittance of 0% is obtained, while when the voltage VH is applied, a transmittance of 100% is obtained. With the structure in which the proportion of the period during which the voltage VL is applied to the liquid crystal layer to the period during which the voltage VH is applied is controlled within the period of one field so that the effective voltages applied to the liquid crystal layer may be V1, V2, . . . , and V6, a tone display corresponding to the above-noted voltages is enabled.

In the electro-optical device according to the present embodiment, as shown in FIG. 6(*b*), one field (1f) is divided into seven sections in order to separate the period during which the voltage VL is applied to the liquid crystal layer from the period during which the voltage VH is applied. The divided sections are referred herein to as sub-fields Sf1, Sf2, . . . , and Sf7 for the sake of convenience.

Specifically, in the electro-optical device according to the present embodiment, either the voltage VL or VH is applied to the liquid crystal layer of pixels according to the tone data in each of the sub-fields Sf1 to Sf7. For example, assuming that the tone display level is expressed by 3-bit tone data, when tone data (001) (hereinafter, the tone levels expressed by the tone data are indicated along with the bit numbers in parentheses) is applied to a given pixel, namely, when a tone display with a transmittance of that pixel of 14.3% is desired, the voltage VH is applied to the liquid crystal layer of the pixel in the sub-field Sf1 of one field (1f) while the voltage VL is applied to the liquid crystal layer in the other sub-fields Sf2 to Sf7. Since the effective voltage is defined by the square root of the value obtained by averaging the squared instantaneous voltages throughout one cycle (one field), the effective voltage applied to the liquid crystal layer in one field (1f) as a result of the above-mentioned applied voltages will be V1 if the sub-field Sf1 is set to be a period of $(V1/VH)^2$ relative to one field (1f).

For example, when tone data (010) is applied to a given pixel, namely, when a tone display with a transmittance of the pixel of 28.6% is desired, the voltage VH is applied to the liquid crystal layer of the pixel in the sub-fields Sf1 and Sf2 of one field (1f) while the voltage VL is applied to the liquid crystal layer in the other sub-fields Sf3 to Sf7. In this regard, if the sub-fields Sf1 and Sf2 are set to be a period of $(V2/VH)^2$ relative to one field (1f), the effective voltage applied to the liquid crystal layer in one field (1f) as a result of the above-mentioned applied voltages will be V2. As previously described, the sub-field Sf1 has been set to be a period of $(V1/VH)^2$, and the sub-field Sf2 should be therefore set to be a period of $(V2/VH)^2-(V1/VH)^2$.

Likewise, for example, when tone data (011) is applied to a given pixel, namely, when a tone display with a transmittance of the pixel of 42.9% is desired, the voltage VH is applied to the liquid crystal layer of the pixel in the sub-fields Sf1 to Sf3 of one field (1f) while the voltage VL is applied to the liquid crystal layer in the other sub-fields Sf4 to Sf7. Thus, if the sub-fields Sf1 to Sf3 are set to be a period of $(V3/VH)^2$ relative to one field (1f), the effective voltage applied to the liquid crystal layer as a result of the above-mentioned applied voltages will be V3. As previously described, the sub-fields Sf1 and Sf2 has been set to be a period of $(V2/VH)^2$, and it is understood that the sub-field Sf3 should be therefore set to be a period of $(V3/VH)^2-(V2/VH)^2$.

Subsequently, periods of the other sub-fields Sf4 to Sf6 can be determined in the same manner. Finally, the sub-field Sf7 is set to be a period obtained by subtracting the sub-fields Sf1 to Sf6 from one field. As previously noted, however, it is necessary that a longer time length than the time length $(V7/VH)^2$ relative to one field (1f) be ensured for the total time length of the sub-fields Sf1 to Sf7. Nevertheless, if the total time length of the sub-fields Sf1 to Sf7 is longer than the time length $(V7/VH)^2$ relative to one field, that is, if the effective voltage applied to the liquid crystal layer exceeds V7, it saturates, resulting in a transmittance of 100%.

In this way, with the structure in which the periods of the sub-fields Sf1 to Sf7 are set so that voltages are applied according to the tone data, a tone display corresponding to the transmittances is achieved although the voltages applied to the liquid crystal layer are binary, namely, VL and VH. For convenience of illustration, hereinafter, the logic amplitude is considered with reference to the voltage VH as an H-level voltage and the voltage VL as an L-level voltage.

In the following description, although an electro-optical device capable of an eight-level tone display according to 3-bit tone data will be described by way of example, of course, it is not intended that the present invention be limited thereto.

FIG. 1 is a block diagram of the electrical structure of an electro-optical device according to a first embodiment of the present invention. The electro-optical device is implemented by a liquid crystal display which uses a twisted nematic (TN) liquid crystal as an electro-optical material, including an element substrate and an opposing substrate which are bonded at a constant spacing therebetween such that the liquid crystal as an electro-optical material is interposed in the spacing. In the electro-optical device, the element substrate is implemented by a transparent substrate made of glass, quartz, or the like, and thin film transistors (TFTs) for driving pixels, complementary TFTs which form a peripheral driving circuit, etc., are formed on the element substrate.

As shown in FIG. 1, a display region 101*a* on the element substrate can includes a plurality of scanning lines 112 extending in the X (row) direction, and a plurality of data lines 114 extending in the Y (column) direction. Pixels 110 are arranged at intersections between the scanning lines 112 and the data lines 114 to form a matrix. For convenience of illustration, although a matrix display device of m rows by n columns having a total of m scanning lines and a total of n data lines 114 (m and n are integers more than one) is described in the present embodiment, it is not intended that the present invention be limited thereto.

Figures 2, 3:
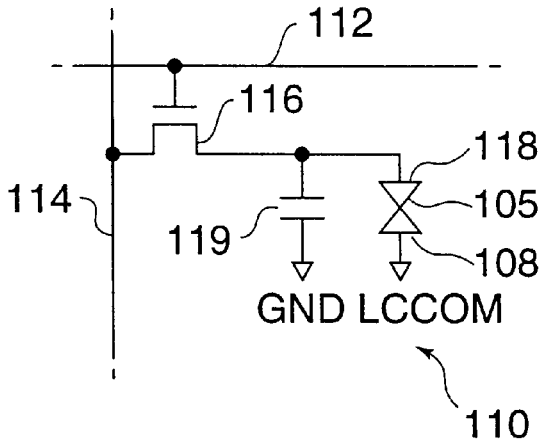
FIG. 2 is a circuit diagram of the structure of a pixel in the electro-optical device.
FIG. 3 is a block diagram of the structure of a data line driving circuit in the electro-optical device.

Next, FIG. 2 is an illustration of the structure of the pixels 110. As shown in the same figure, the pixels 110 according to the present embodiment include a transistor 116, such as a thin film transistor (TFT) having a gate, source, and drain connected to the scanning line 112, the data line 114, and a pixel electrode 118, respectively, and a liquid crystal 105 as an electro-optical material which is interposed between the pixel electrode 118 and a counter electrode 108 to form a liquid crystal layer. Here, an accumulated capacitance 119 is formed between the pixel electrode 18 and the ground potential GND (=0 V, but may be an L-level voltage of a data signal as will be described later, a counter electrode voltage LCCOM, or any other potential). The accumulated capacitance 119 is a capacitance provided to maintain the voltage which has been applied to the pixel electrode 118 through the transistor 116 substantially constant for the required time period. The counter electrode 108 is a transparent electrode which is formed over the opposing substrate so as to face the pixel electrode 118. A constant voltage (hereinafter referred to as "counter electrode voltage LCCOM") generated by a voltage generating circuit (not shown) is applied to the counter electrode 108.

Referring again to FIG. 1, a timing signal generating circuit 200 is a device for generating various timing signals, clock signals, etc. according to a vertical scanning signal Vs, a horizontal scanning signal Hs, and a dot clock signal DCLK which are fed by higher level devices (not shown). The principal signals generated by the timing signal generating circuit 200 are enumerated as follows, by way of example.

a. Field-reverse Driving Signal FR

The field-reverse driving signal FR is a signal for determining the voltage level of data signals d1, d2, d3, . . . and dn output from a data line driving circuit 140. The field-reverse driving signal FR in the present embodiment is repeatedly level-inverted every field such as from the H-level to the L-level and from the L-level to the H-level.

b. Start Pulse DY

The start pulse DY is a pulse signal which is output at the beginning of each of the seven sub-fields divided from one field.

c. Clock Signal CLY

The clock signal CLY is a signal for defining the horizontal scanning period at the scanning side (Y side).

d. Latch Pulse Signal LP

The latch pulse signal LP is a pulse signal output at the beginning of the horizontal scanning period and is output at the level transitions (that is, at the rising and falling edges) of the clock signal CLY.

e. Clock Signal CLX

The clock signal CLX is a signal for defining a so-called dot clock.

As mentioned above, the principal signals generated by the timing signal generating circuit 200 have been briefly described.

A scanning line driving circuit 130 is generally called a Y shift register for transferring the start pulse DY fed at the beginning of each sub-field according to the clock signal CLY so as to output it as scanning signals G1, G2, G3, . . . and Gm, in turn, to the scanning lines 112, respectively.

Next, a data converting circuit 300 is described. In the present embodiment, one field is divided into seven sub-fields Sf1 to Sf7, and the pixels 110 are turned on/off according to 3-bit tone data in each sub-field to display an eight-level tone image. Based on the tone data for each of the pixels 110, the data converting circuit 300 generates a binary signal Ds in each sub-field which indicates that the associated pixel 100 should be turned on/off. FIG. 3 shows a truth table which illustrates the functionality of the data converting circuit 300.

In FIG. 3, H-level binary signals Ds represent a function to turn on the pixel 110, and L-level binary signals Ds represent a function to turn off the pixel 110. For example, for tone data (000), the L-level binary signals Ds which indicates that the pixel 110 is turned off are output in all of the sub-fields Sf1 to Sf7. For tone data (001), the H-level binary signal Ds which indicates that the pixel 110 is turned on is output in the sub-field Sf1, while the L-level binary signals Ds which indicate that the pixel 110 is turn off are output in the other sub-fields Sf2 to Sf7.

It is necessary for the binary signal Ds generated by the data converting circuit 300 to be output synchronously with the operations of the scanning line driving circuit 130 and the data line driving circuit 140. Hence, in FIG. 1, the start pulse DY, the clock signal CLY which synchronizes with the horizontal scanning, the latch pulse LP which defines the beginning of the horizontal scanning period, and the clock signal CLX which corresponds to a dot clock signal are fed to the data converting circuit 300.

Next, the data line driving circuit 140 selects any one of the three kinds of voltages Vs1, Vs2, and Vc based on the above-described binary signal Ds and field-reverse driving signal FR to supply the data signals d1, d2, d3, . . . , and dn of the selected voltage to the data lines 114 all at once. A specific configuration of the data line driving circuit 140 is as shown in FIG. 4.

Figure 4:
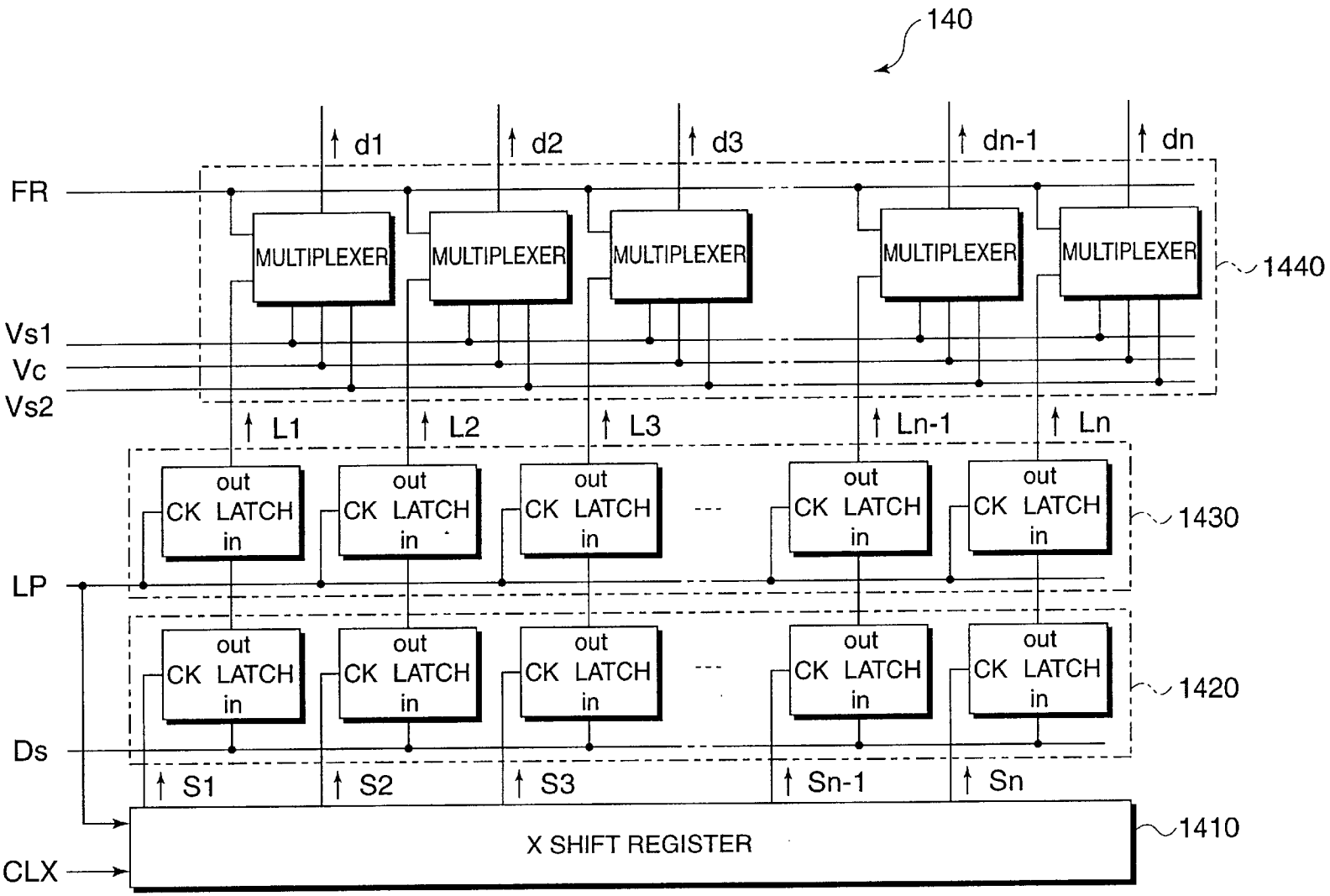
FIG. 4 shows a truth table which illustrates the functionality of a multiplexer circuit in the data line driving circuit.

As shown in FIG. 4, the data line driving circuit 140 is constituted by an X shift register 1410, a first latch circuit 1420, a second latch circuit 1430, and a multiplexer circuit 1440. The X shift register 1410 transfers the latch pulse LP, which is fed from the timing signal generating circuit 200 at the beginning of the horizontal scanning period, according to the clock signal CLX so that latch signals S1, S2, S3, . . . , and Sn are sequentially output.

The first latch circuit 1420 sequentially latches the binary signals Ds fed from the data converting circuit 300 at the timing of the falling edges of the latch signals S1, S2, S3, . . . , and Sn. The second latch circuit 1430 latches the binary signals Ds, which have been latched by the first latch circuit 1420, all at once at the timing of the falling edge of the latch pulse LP so as to output it as signals L1, L2, L3, . . . , and Ln to the multiplexer circuit 1440.

The voltages Vs1, Vs2, and Vc from a voltage supply circuit (not shown), the field-reverse driving signal FR from the timing signal generating circuit 200, and the signals L1, L2, L3, . . . , and Ln from the second latch circuit 1430 are fed to the multiplexer circuit 1440. The multiplexer circuit 1440 selects any one of the voltages Vs1, Vs2, and Vc according to the field-reverse driving signal FR and the output signals Lj (j is an integer satisfying $0 \leqq j \leqq n$) of the second latch circuit 1430, and supplies a data signals dj of the selected voltage level to the data lines 114.

The voltage Vc has the same level as the above-described counter electrode voltage LCCOM. The voltage Vs1 is higher than the voltage Vc (=the counter electrode voltage LCCOM) by the above-described voltage VH. The voltage Vs2 is lower than the voltage Vc (=the counter electrode voltage LCCOM) by the above-described voltage VH.

FIG. 5 shows a truth table which illustrates the functionality of the multiplexer circuit 1440. As shown in the same figure, whenever an L-level signal Lj is fed from the second latch circuit 1430, the multiplexer 1440 supplies a data signal dj of the voltage Vc to the data lines 114 regardless of the level of the field-reverse driving signal FR. Since the voltage Vc is equal to the counter electrode voltage LCCOM, when the voltage Vc is applied to the pixel electrode 118, the voltage applied to the liquid crystal layer of the associated pixel 110 is VL (=0 V).

On the other hand, whenever an H-level signal Lj is fed from the second latch circuit 1430, the multiplexer circuit 1440 selects either the voltage Vs1 or Vs2 according to the field-reverse driving signal FR, and supplies a data signal dj of the selected voltage level to the data lines 114. Specifically, when the H-level signal Lj is fed from the second latch circuit 1430 and the field-reverse driving signal FR is at the H-level, the multiplexer circuit 1440 supplies the data signal dj of the voltage Vs1 to the data lines 114. On the other hand, it supplies the data signal dj of the voltage Vs2 to the data lines 114 when the H-level signal Lj is fed from the second latch circuit 1430 and the field-reverse driving signal FR is at the L-level. As mentioned above, the voltage Vs1 is VH higher than the voltage Vc (=the counter electrode voltage LCCOM), and the voltage Vs2 is VH lower than the voltage Vc. Therefore, when the voltage Vs1 or Vs2 is applied to the pixel electrode 118, it is implied that the voltage VH is applied to the liquid crystal layer of the associated pixel 110.

The transistors constituting the scanning line driving circuit 130 and the data line driving circuit 140 may be composed of the TFTs formed on the element substrate.

Figure 7:
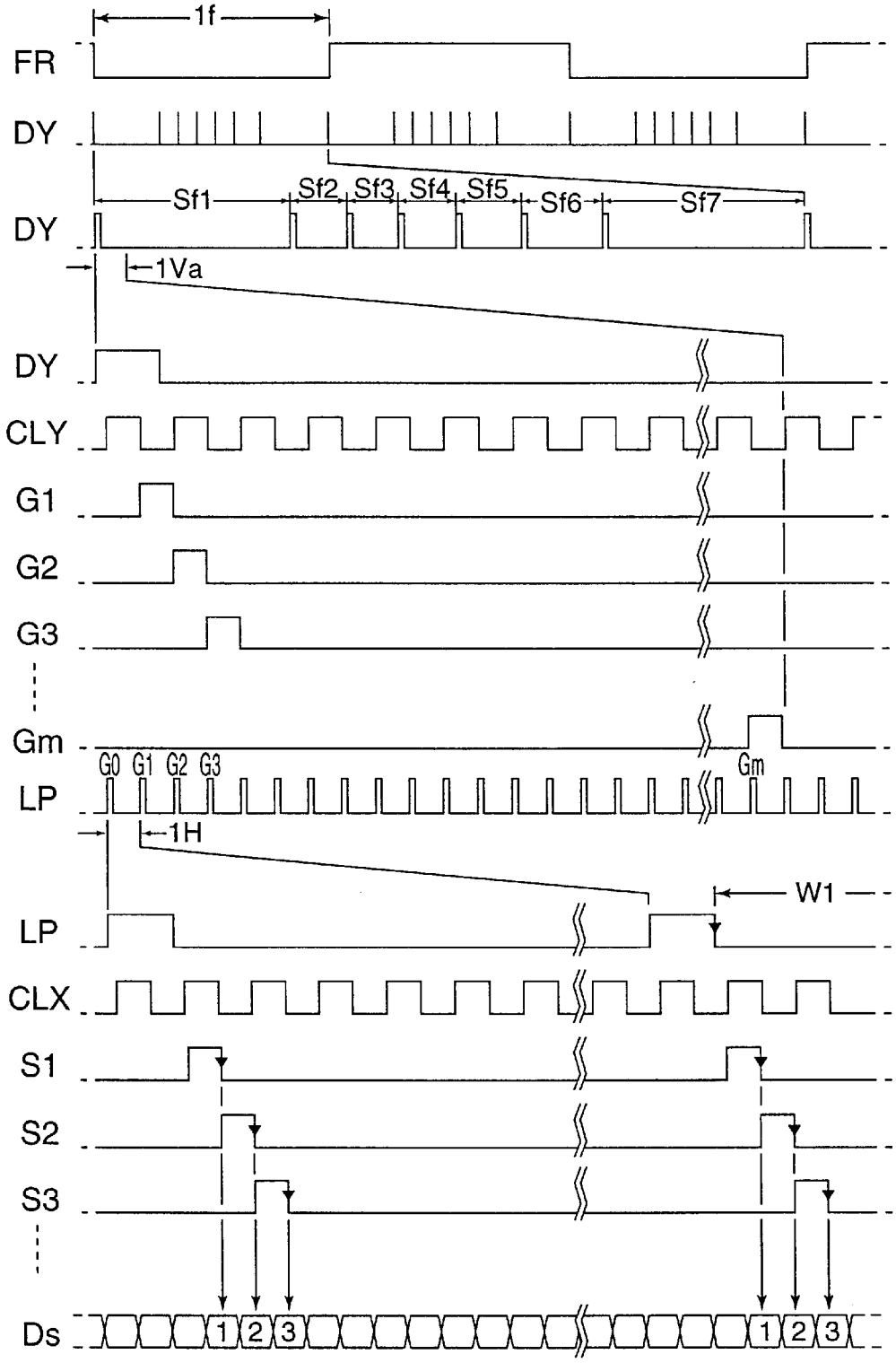
FIG. 7 is a timing chart showing the operation of the electro-optical device.
Figure 8:
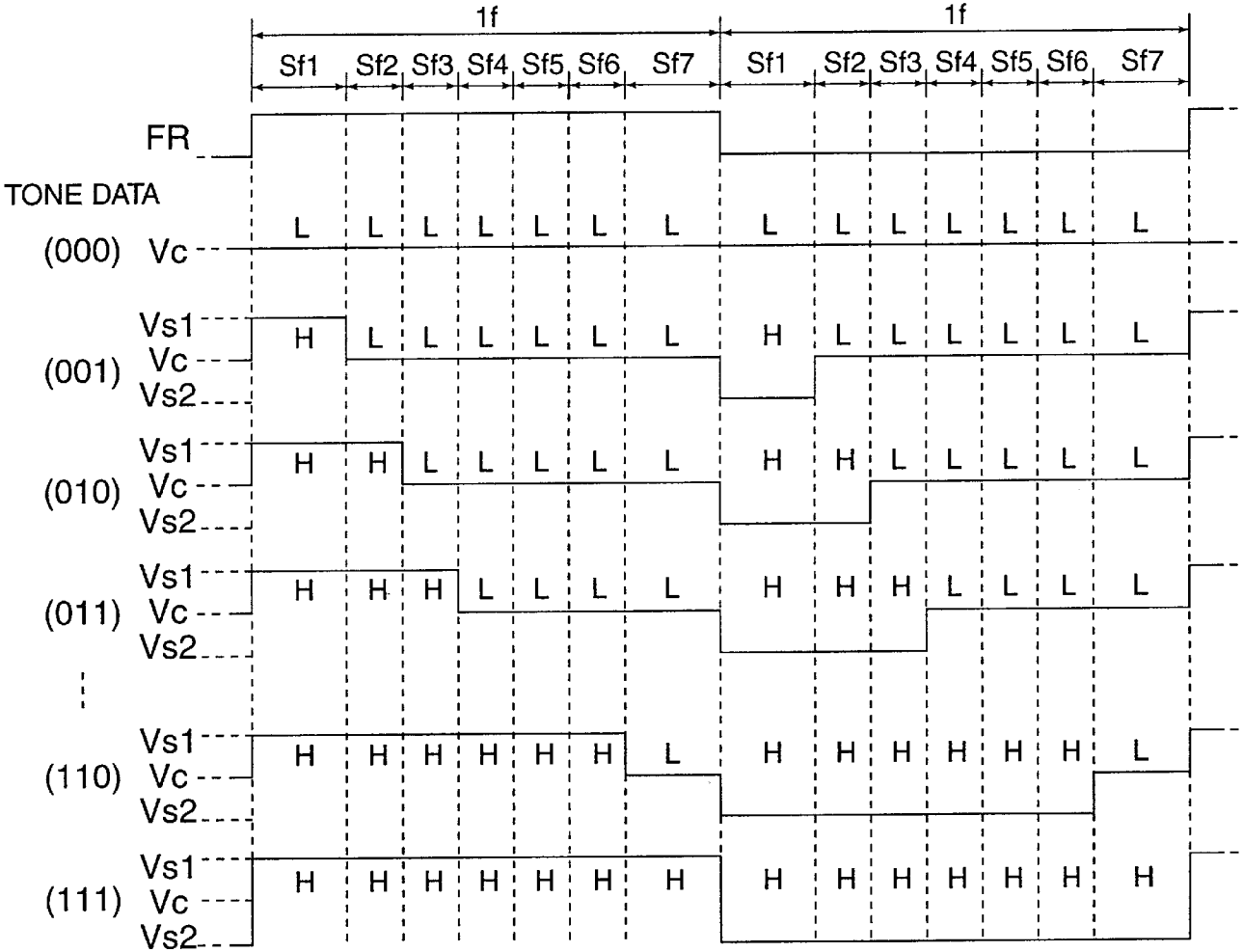
FIG. 8 is a timing chart illustrating the voltages to be applied to the pixels in the electro-optical device.

Next, the operation of the electro-optical device according to the present embodiment as described above is described. FIGS. 7 and 8 are timing charts showing the operation of this electro-optical device.

As shown in FIG. 7, the start pulse DY is output from the timing signal generating circuit 200 at the timing when each of the seven sub-fields divided from one field begins. Once the start pulse DY which defines the beginning of the sub-field Sf1 is fed, the scanning line driving circuit 130 (see FIG. 1) transfers the start pulse DY according to the clock signal CLY, and as a result, the scanning signals G1, G2, G3, . . . , and Gm are sequentially output within a data transfer period (1 Va). The data transfer period (1 Va) shown in FIG. 7 is set at a period equal to or shorter than the sub-fields (that is, $1\ Va \leqq Sfk$ (k is an integer satisfying $0 \leqq k \leqq 7$) is satisfied). As used herein, the data transfer period (1 Va) is a period from when the scanning signal G1 is supplied to a first scanning line 112 from the top until the scanning signal Gm has been supplied to an m-th scanning line 112.

Each of the scanning signals G1, G2, G3, . . . , and Gm has a pulse width corresponding to a half cycle of the clock signal CLY, and the scanning signal G1 corresponding to a first scanning line 112 from the top is output with a delay of at least a half cycle of the clock signal CLY behind a first rising edge of the clock signal CLY after the start pulse DY has been fed. Therefore, one shot of the latch pulse LP (indicated by "G0" in FIG. 7) is supplied to the data line driving circuit 140 during a period from when the start pulse DY is fed at the beginning of a sub-field until the scanning signal G1 is output.

Now, consider the instance where the one shot (G0) of the latch pulse LP is supplied. When the one shot (G0) of the latch pulse LP is supplied to the data line driving circuit 140, the X shift register 1410 transfers the latch pulse LP according to the clock signal CLX, and as a result, the latch signals S1, S2, S3, . . . , and Sn are sequentially output within a horizontal scanning period (1H). Each of the latch signals S1, S2, S3, . . . , and Sn has a pulse width corresponding to a half cycle of the clock signal CLX.

At the falling edge of the latch signal S1, the first latch circuit 1420 in FIG. 4 latches the binary signal Ds fed to the pixel 110 at the intersection between a first scanning line 112 from the top and a first data line 114 from the left. Then, at the falling edge of the latch signal S2, the first latch circuit 1420 latches the binary signal Ds fed to the pixel 110 at the intersection between a first scanning line 112 from the top and a second data line 114 from the left. The same operation is sequentially performed until the binary signal Ds fed to the pixel 110 at the intersection between a first scanning line 112 from the top and an n-th data line 114 from the left has been latched.

This allows the binary signals Ds at a row of pixels at the intersections with a first scanning line from the top to be latched in turn by the first latch circuit 1420. It is to be understood that the data converting circuit 300 converts the tone data for the pixels to binary signals Ds, and outputs the results at the timing when the first latch circuit 1420 latches.

Next, as the scanning signal G1 is output at a falling edge of the clock signal CLY, a first scanning line 112 from the top in FIG. 1 is selected, so that the transistors 116 of the pixels 110 at the intersections with that scanning line 112 are all turned on. On the other hand, the latch pulse LP is output at this falling edge of the clock signal CLY. At the timing of the falling edge of the latch pulse LP, the second latch circuit 1430 supplies the binary signals Ds sequentially latched by the first latch circuit 1420 to the multiplexer circuit 1440 all at once as the signals L1, L2, L3, . . . , and Ln.

In parallel with this operation, the binary signals Ds for a row of pixels at the intersections with a second scanning line 112 from the top in FIG. 1 are sequentially latched by the first latch circuit 1420.

On the other hand, the multiplexer circuit 1440 selects any one of the voltages Vs1, Vc, and Vs2 according to the truth table shown in FIG. 5 based on the signals L1, L2, L3, . . . , and Ln fed from the second latch circuit 1430 and the field-reverse driving signal FR, and outputs data signals d1, d2, d3, . . . , and dn of the selected voltage to the data lines 114. For example, if the signal L1 fed from the second latch circuit 1430 is at the H-level in the field where the field-reverse driving signal FR is at the H-level, the multiplexer circuit 1440 supplies the data signal d1 of the voltage Vs1 to a first data line 114 from the left. If the signal L2 fed from the second latch circuit 1430 is at the L-level in the same state, the multiplexer circuit 1440 supplies the data signal d2 of the voltage Vc to a second data line 114 from the left. Accordingly, the data signals d1, d2, d3, . . . , and dn are concurrently written into a first pixel 110 from the top.

The same operation is subsequently repeated until the scanning signal Gm corresponding to the m-th scanning line 112 is output. In other words, within one horizontal scanning period (1H) during which a given scanning signal Gi (i is an integer satisfying $0 \leqq i \leqq m$) is output, the data signals d1 to dn are written into the n pixels 110 at an i-th scanning line while the binary signals Ds fed to a row of pixels 110 connected to an (i+1)-th scanning line 112 are latched in a parallel manner. The data signals written into the pixels 110 are stored until writing in the next sub-field Sf2.

The same operation is subsequently repeated each time the start pulse DY which defines the beginning of each sub-field is fed.

When, in the next field, the field-reverse driving signal FR is turned to the L-level, the same operation is also repeated in each sub-field. In this instance, however, when the H-level signal Lj is fed, as shown in FIG. 5, the multiplexer circuit 1440 in the data line driving circuit 140 supplies the data signal dj of the voltage Vs2 to the data lines 114.

Next, the voltage applied to the liquid crystal layer of the pixels 110 by performing such an operation is considered. FIG. 8 is a timing chart showing the tone data and the waveforms of the voltages applied to the pixel electrode 118 of the pixel 110.

For example, when the tone data (000) is applied to a given pixel in the field where the field-reverse driving signal FR is at the H-level, according to the truth tables shown in FIGS. 3 and 5, the voltage Vc is applied to the pixel electrode 118 of the pixel 110 throughout one field (1f), as shown in FIG. 8. Since the voltage Vc is equal to the counter electrode voltage LCCOM, the effective voltage applied to the liquid crystal layer of the pixel 110 in one field is 0 V (=VL). As a result, the transmittance of the pixel 110 is 0% corresponding to the tone data (000). On the other hand, when, in the next field, the field-reverse driving signal FR is turned to the L-level, the voltage Vc is still applied to the pixel electrode 118 of the pixel 110 throughout one field, and thus the transmittance of the pixel 110 is 0%.

Next, if the tone data (001) is applied to a given pixel 110 in a field where the field-reverse driving signal is at the H-level, according to the truth tables shown in FIGS. 3 and 5, the voltage Vs1 and the voltage Vc are applied to the pixel electrode 118 of the pixel 110 in the sub-field Sf1 and in the other sub-fields Sf2 to Sf7, respectively, as shown in FIG. 8. That is, in the sub-field Sf1, VH that is a differential voltage between the counter electrode voltage LCCOM applied to the counter electrode 108 and the voltage Vs1 applied to the pixel electrode 118 is applied to the liquid crystal layer of the pixel 110. In the sub-fields Sf2 to Sf7, on the other hand, the voltage applied to the liquid crystal layer is 0 V. The proportion of the period of the sub-field Sf1 within one field (1f) is expressed as $(V1/VH)^2$, during which the voltage VH is applied, so that the effective voltage applied to the liquid crystal layer of the pixel 110 in one field is V1 shown in FIG. 6(*a*). Therefore, the transmittance of the pixel 110 is 14.3% corresponding to the tone data (001).

On the other hand, when, in the next field, the field-reverse driving signal FR is turned to the L-level, the voltage Vs2 and the voltage Vc are applied to the pixel electrode 118 in the sub-field Sf1 and the other sub-fields Sf2 to Sf7 of one field, respectively, so that the transmittance of the pixel 110 is 14.3% corresponding to the tone data (001) as is the same as the case where the field-reverse driving signal FR is at the H-level. As is apparent from the foregoing description, the voltage applied to the liquid crystal layer in a field where the field-reverse driving signal FR is at the L-level has a polarity opposite to the voltage applied to the liquid crystal layer in a field where the field-reverse driving signal FR is at the H-level, but has the same absolute value. Since the field-reverse driving signal FR is level-inverted periodically, the polarity of the voltage applied to the liquid crystal layer is also periodically inverted. As a result, the situation where a DC component is applied to the liquid crystal layer is avoided, thus advantageously preventing the liquid crystal 105 from being degraded. Of course, this advantage can also be achieved when other tone data is applied.

Next, when the tone data (010) is applied to a given pixel 110 in a field where the field-reverse driving signal FR is at the H-level, as is apparent from FIG. 8 the voltage VH and the voltage VL are applied to the pixel electrode 118 of the pixel 110 in the sub-fields Sf1 and Sf2 and the other sub-fields Sf3 to Sf7, respectively. The proportion of the period of the sub-fields Sf1 and Sf2 in one field (1f) is expressed as $(V2/VH)^2$, during which the voltage VH is applied, so that the effective voltage applied to the liquid crystal layer of the pixel 110 in one field is V2. Therefore, the transmittance of the pixel 110 is 28.6% corresponding to the tone data (010). The same is true in a field where the field-reverse driving signal FR is at the L-level.

The same can be true for the case where other tone data is applied. Accordingly, the sub-field(s) where a given pixel is turned on and the sub-field(s) where the pixel 110 is turned off are determined according to the tone data. In the sub-field(s) where the pixel 110 is turned on, the voltage Vs1 and the voltage Vs2 are applied to the pixel electrode 118 when the field-reverse driving signal FR is at the H-level and when the field-reverse driving signal FR is at the L-level, respectively. As a result, the effective voltage to obtain the transmittance corresponding to the desired tone data is applied to the liquid crystal layer, making it possible to provide a tone display according to that tone data.

According to the present embodiment, therefore, one field is divided into a plurality of sub-fields Sf1 to Sf7, and either voltage VH or VL is applied to the liquid crystal layer of each pixel in each of the sub-fields to control the effective voltage within one field. Thus, peripheral circuits such as driving circuits do not require circuits, such as a high-accurate D/A converting circuit and an operational amplifier, for processing analog signals, which are essential in the prior art. Accordingly, this provides significant simplification of circuit structure, reducing the cost of the overall device. Furthermore, the voltage applied to the liquid crystal layer of the pixel is either VL (=0 V) or VH and is thus binary, thereby preventing nonuniform display caused by nonuniformity in component characteristics, wiring resistances, etc. in principle. Therefore, the electro-optical device according to the present embodiment achieves a high-quality and high-definition tone display.

Furthermore, according to the present embodiment, a constant voltage is applied to the counter electrodes while voltage Vs1, Vs2, or Vc is applied to the pixel electrodes, and there are advantages that the situation where the effective voltages applied to the pixels are different depending upon positions of the pixels can be avoided while applying a DC component to the liquid crystal layer can be avoided. A specific description is as follows.

Figure 9:
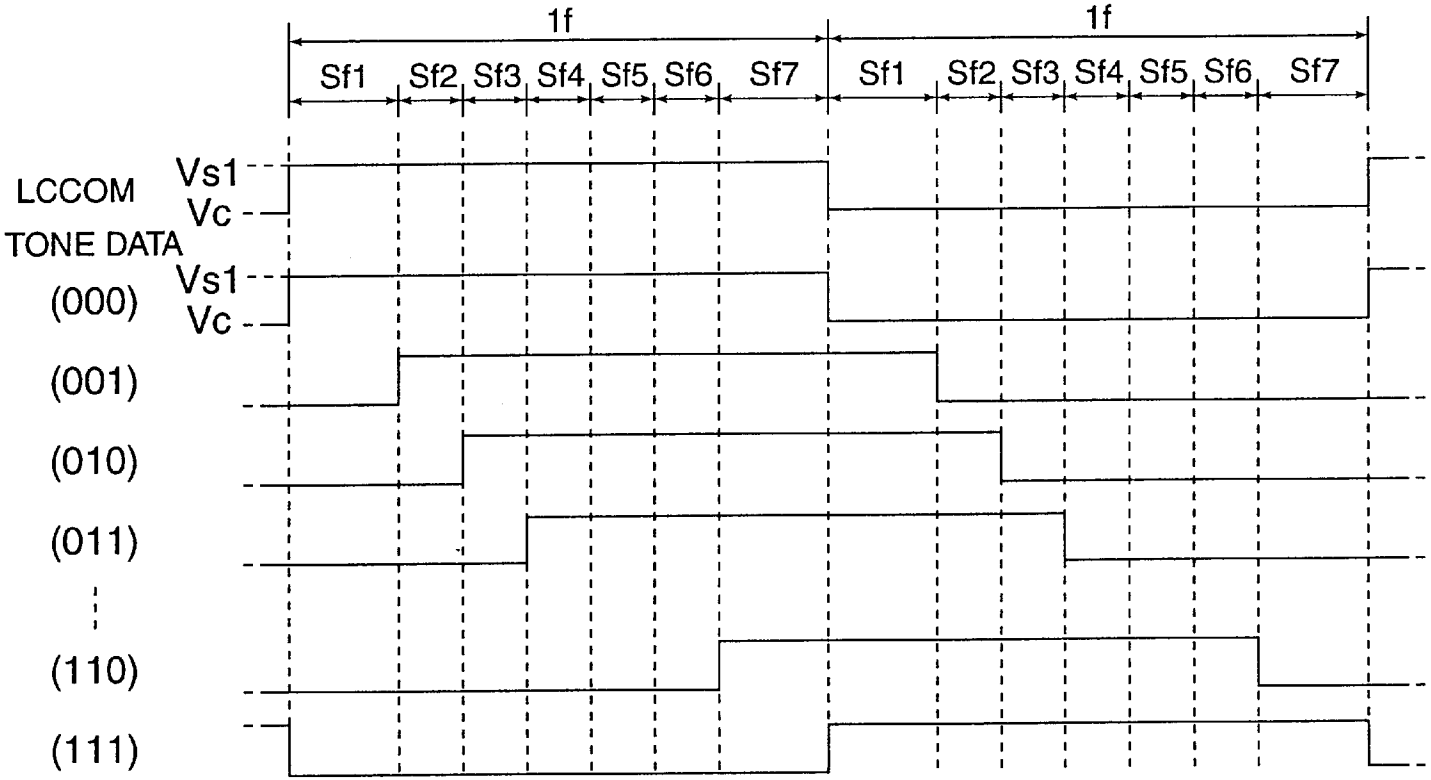
FIG. 9 is a view for illustrating the advantages of the electro-optical device.

Here, for comparison with a driving method according to the present embodiment, consider the case where a driving method different from that of the present embodiment (hereinafter referred to "different driving method") is adopted to avoid a DC component from being applied to the liquid crystal layer. Specifically, in the above-noted different driving method, as shown in FIG. 9, the counter electrode voltage LCCOM is level-inverted every field such as from the H-level to the L-level and from the L-level to the H-level. Here, a voltage Vs1 is at the H-level and Vc is at the L-level. Within a field where the counter electrode voltage LCCOM is at the H-level (Vs1), in a sub-field where a given pixel 110 should be turned on, the voltage Vc is applied to the pixel electrode 118 of the pixel 110, and in a sub-field where the pixel 110 should be turned off, the voltage Vs1 is applied to the pixel electrode 118 of the pixel 110.

By doing so, VH that is a differential voltage between the voltage Vs1 and the voltage Vc is applied to the liquid crystal layer in the sub-field where the pixel 110 should be turned on, while the voltage applied to the liquid crystal layer is 0 V in the sub-field where the pixel 110 should be turned off. On the other hand, within a field where the counter electrode voltage LCCOM is at the L-level (Vc), in a sub-field where a given pixel should be turned on, the voltage Vs1 is applied to the pixel electrode of that pixel, and in a sub-field where the pixel should be turned off, the voltage Vc is applied to the pixel electrode of that pixel. This also avoids a DC component from being applied to the liquid crystal layer. By adopting this method, however, problems occur as follows.

Figure 10:
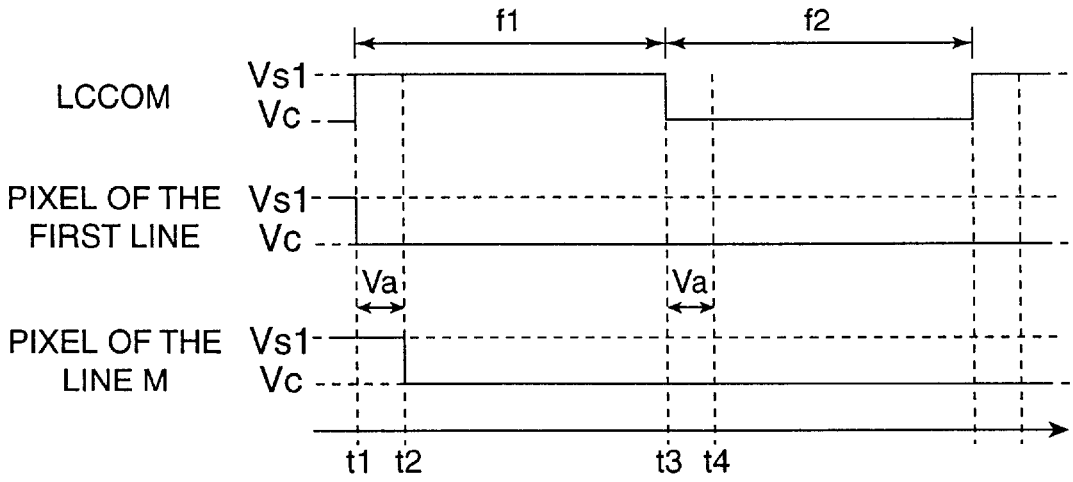
FIG. 10 is a view illustrating the effect of the electro-optical device.

FIG. 10 is an illustration of the relationship of the counter electrode voltage LCCOM, the voltage applied to the pixel electrodes 118 of the pixels 110 connected to a first scanning line 112 from the top (hereinafter referred to as "first row of pixels"), and the voltage applied to the pixel electrodes 118 of the pixels 110 connected to an m-th scanning line 112 from the top (hereinafter referred to as "m-th row of pixels"). For convenience of illustration, FIG. 10 shows by way of example that the first row of pixels 110 and the m-th row of pixels 110 are turned on in all of the sub-fields in a field f1, while the first row of pixels 110 and the m-th row of pixels 110 are turned off in all of the sub-fields in a field f2.

As shown in FIG. 10, to the pixel electrodes 118 of the first row of pixels 110, the voltage Vc is written at a time t1 immediately after the field f1 starts so that the pixels 110 are turned on, and the voltage Vc is written at a time t3 immediately after the field f2 starts so that the pixels 110 are turned off.

On the other hand, to the pixel electrodes 118 of the m-th row of pixels 110, the voltage Vc is written at a time t2 when a data transfer period (1 Va) elapses after the time t1 so that the pixels 110 are turned on, and the voltage Vc is written at a time t4 when the data transfer period (1 Va) elapses after the time t3 so that the pixels 110 are turned off. As used herein, the data transfer period is the same period as the data transfer period shown in FIG. 7, and is a period from when the scanning signal G1 is supplied to a first scanning line 112 from the top until the scanning signal Gm has been supplied to an m-th scanning line 112.

As a result, the voltage VH is applied to the liquid crystal layer of the first row of pixels 110 for a period of the times t1 to t3. Since the tone data for the first row of pixels 110 and the tone data for the m-th row of pixels 110 are assumed herein to be the same, in principle, the voltage VH should be applied to the liquid crystal layer of the m-th row of pixels 110 for the same period as that in the first row of pixels 110, namely, for a period of times t2 to t4. In effect, however, the voltage VH is applied to the liquid crystal layer of the m-th row of pixels 110 only for a period of the times t2 to t3 because the counter electrode voltage LCCOM is level-inverted at the time t3. Therefore the counter electrode voltage LCCOM is level-inverted, resulting in a voltage of 0 V applied to the liquid crystal layer of the m-th row of pixels 110 for a period of the times t3 to t4. Accordingly, if the above-noted different driving method is adopted, the applied effective voltages are nonuniform depending upon positions of the pixels 110. As a result, a problem occurs in that a nonuniform display is provided on the overall screen.

In contrast, according to the present embodiment, since the level of the counter electrode voltage LCCOM applied to the counter electrode is maintained constant, no deviation occurs in the effective voltages depending upon positions of the pixels 110. Therefore, the problem, as previously described with respect to the different driving method, which results from the data transfer period does not arise. Further, and advantageously, in the present invention a uniform display is realized with comparison to the different driving method.

It will be noted that the counter-electrode voltage LCCOM and the voltage Vc may not be necessarily the same as long as there is a voltage difference therebetween to such an extent that the pixels may not be turned on. Furthermore, the counter electrode voltage LCCOM may be voltage-shifted to compensate a change in the voltage applied to the pixel electrodes due to parasitic capacitances of the TFTs in the pixels. However, in such a case that the counter electrode voltage LCCOM is shifted to compensate a drop of the voltage applied to the pixel electrodes, the voltages Vs1 and Vs2 must also be shifted in the same direction.

Figure 11:
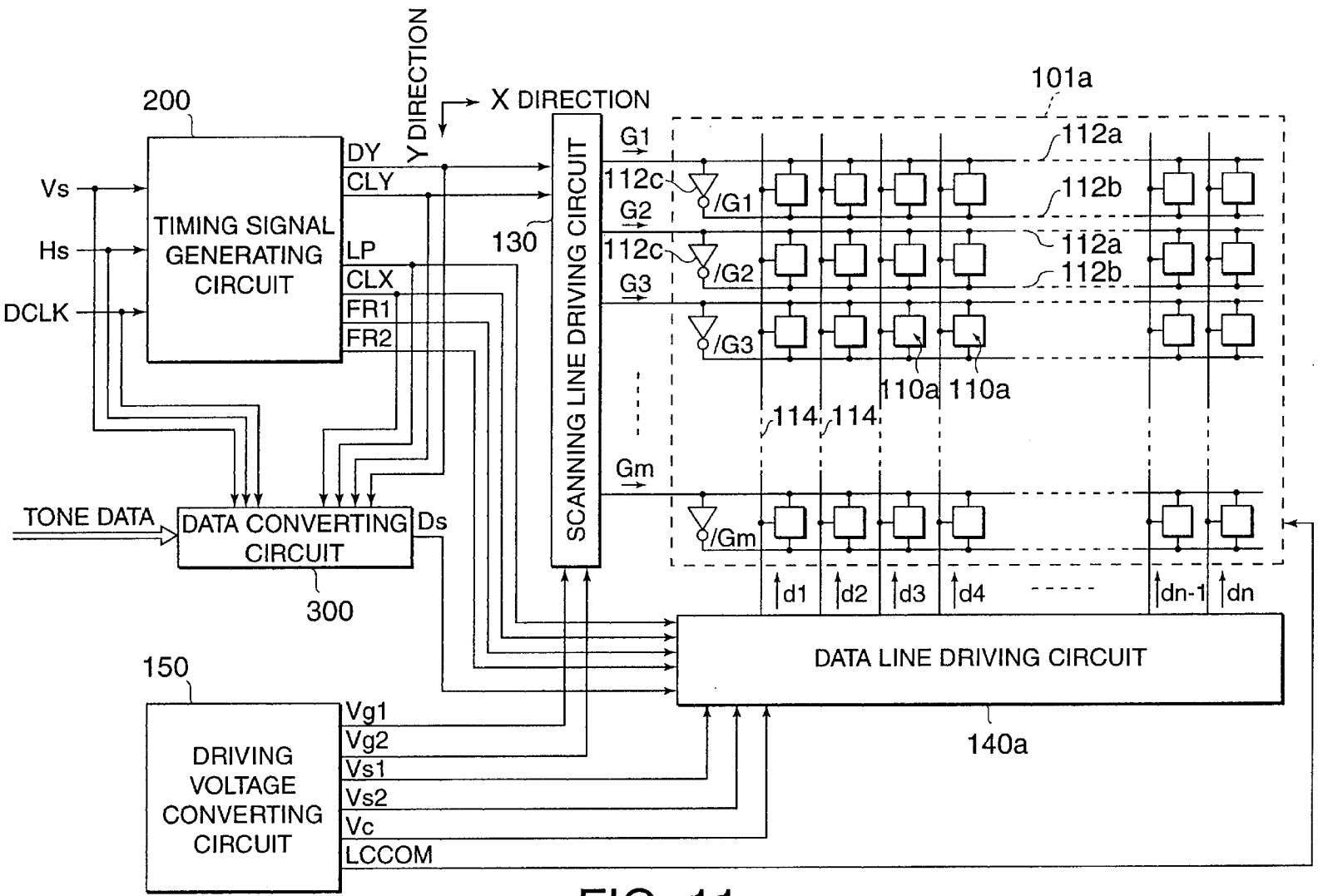
FIG. 11 is an exemplary block diagram of the structure of an electro-optical device according to a second embodiment of the present invention.

Next, a driving method of an electro-optical device according to a second embodiment is described. FIG. 11 is an exemplary block diagram of the structure of an electro-optical device according to the present embodiment. The same reference numerals as those in FIG. 1 are given to components shown in FIG. 11 which are common to those of the electro-optical device according to the first embodiment shown in FIG. 1, and a description thereof is thus omitted.

As shown in FIG. 11, the electro-optical device according to the present embodiment can include a plurality of scanning lines 112*a* and scanning lines 112*b* extending in the X (row) direction. One end of each of the scanning lines 112*b* (one left end in the figure) is connected via an inverter 112*c* to one scanning line 112*a* adjacent thereto via a pixel 110*a*, so that each scanning line 112*a* and each scanning line 112*b* are paired. As a result, the scanning line 112*b* receives a signal (hereinafter referred to "inverted scanning-signal/Gi") obtained by level-inverting a scanning signal Gi fed to the scanning line 112*a* mating with that scanning line 112*b*. In the following description, a total of m scanning lines 112*a* and a total of m scanning lines 112*b* (m is an integer more than one) are provided, but it is not intended that the present invention be limited thereto.

Figure 12:
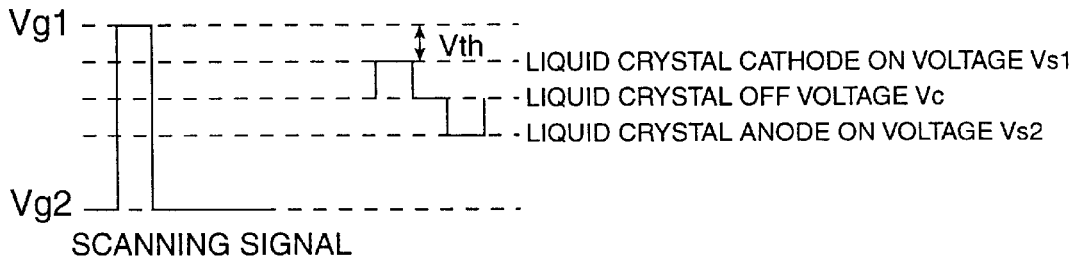
FIG. 12(*a*) is a view showing the relationship between a scanning line signal and the voltages of a data signal in the pixel according to the first embodiment, FIG. 12(*b*) is a circuit diagram of the structure of a pixel in the electro-optical device according to the second embodiment, and FIG. 12(*c*) is a view showing the relationship between scanning line signals and the voltages of a data signal in the same electro-optical device.
Figure 12:
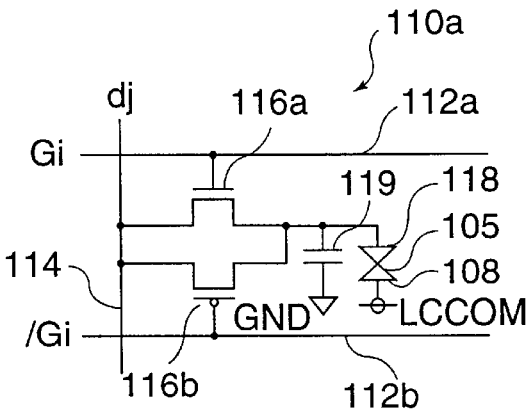
Figure 12:
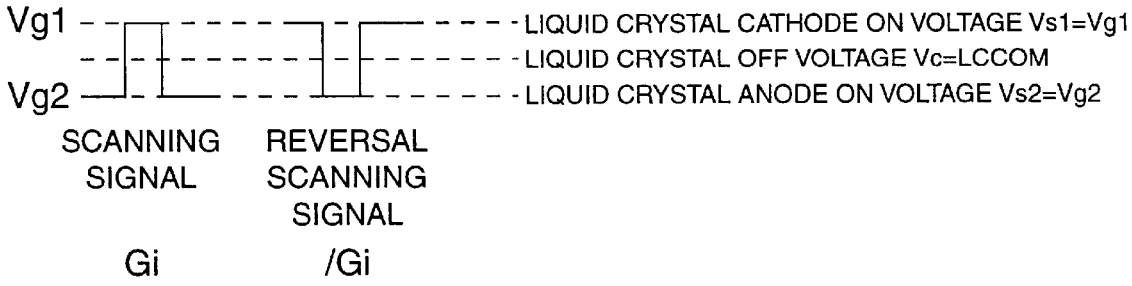

The structure of the pixels 110*a* according to the present embodiment is as follows. In the electro-optical device according to the first embodiment, the transistor 116 used in the pixels is that of only the either-channel type (for example, only the n-channel type). When the pixel electrode 118 is charged via the transistor 116 from the data line 114, once the voltage applied to the pixel electrode 118 reaches a voltage lower than the voltage on the scanning line 112 by a threshold voltage Vth of the transistor, the transistor 116 is turned off to stop charging the pixel electrode 118. For this reason, the voltage applied to the scanning line 112 must be higher than the voltage applied to the data line 114 by the threshold voltage Vth of the transistor 116. Therefore, as shown in FIG. 12(*a*), it is necessary to make a voltage Vg1 of an H-level scanning signal Gi higher than a voltage Vs1 of the data signal 114 which is applied to the data line 114 by the threshold voltage Vth of the transistor. Accordingly, while the pixels 110 that are configured as shown in FIG. 2 would have an advantage in that the structure can be simple, a problem can occur in that the power consumption increases because the voltage applied to the scanning line 112 must be higher. In order to overcome such a problem, according to the present embodiment, the pixels has a structure as shown in FIG. 12(*b*).

As shown in FIG. 12(*b*), the pixels 110*a* in the present embodiment employ both an n-channel transistor 116*a* and a p-channel transistor 116*b* which are complementarily combined into a transmission gate structure, in place of the transistor 116 in the pixels 110 in the previous embodiment. The gate of the n-channel transistor 116*a* is connected to the scanning line 112*a*, while the gate of the p-channel transistor 116*b* is connected to the scanning line 112*b*. The source of each of the transistors is connected to the data line 114, and the drain of each of the transistors is connected to the pixel electrode 118.

In such a structure, while the scanning signal Gi is at the H-level (while the inverted scanning signal/Gi is at the L-level), the data signal dj is fed to pixel electrode 118 via the n-channel transistor 116*a* and the p-channel transistor 116*b*. In this regard, the p-channel transistor 116*b* to which the inverted scanning signal/Gi is fed fully conducts when the data signal dj is at the positive-polarity ON level (voltage Vs1), and the n-channel transistor 116*a* to which the scanning signal Gi is fed fully conducts when the data signal dj is at the negative-polarity ON level (voltage Vs2). Therefore, the amplitude (Vg1-Vg2) of the voltage of the scanning signal Gi should be higher than or equal to the amplitude (Vs1-Vs2) of the voltage of the data signal dj. This is advantageous in that the voltage level of the scanning signal Gi can be reduced compared with the case where the pixels 110 having the structure shown in FIG. 2 are employed.

Furthermore, according to the present embodiment, as shown in FIG. 12(*c*), the H-level voltage Vg1 of the scanning signal Gi and the voltage Vs1 applied to the data lines 114 are at the same level, and the L-level voltage Vg2 of the scanning signal Gi and the voltage Vs2 applied to the data lines 114 are at the same level. By doing so, advantageously, the number of voltage levels to be used in the electro-optical device can be reduced, thereby providing simplification of peripheral circuit structure and reducing the power consumption.

Referring again to FIG. 11, a driving voltage generating circuit 150 generates the voltages Vg1 and Vg2 applied to the scanning lines 112, the voltages Vs1, Vs2, and Vc applied to the data lines 114, and the counter electrode voltage LCCOM. As previously described, the voltages Vg1 and Vs1 are at the same level, and the voltages Vg2 and Vs2 are at the same level. As in the first embodiment, the counter electrode voltage LCCOM and the voltage Vc are at the same level (see FIG. 12(*c*)). The driving voltage generating circuit 150 thus generates and outputs three kinds of voltages.

Figure 13:
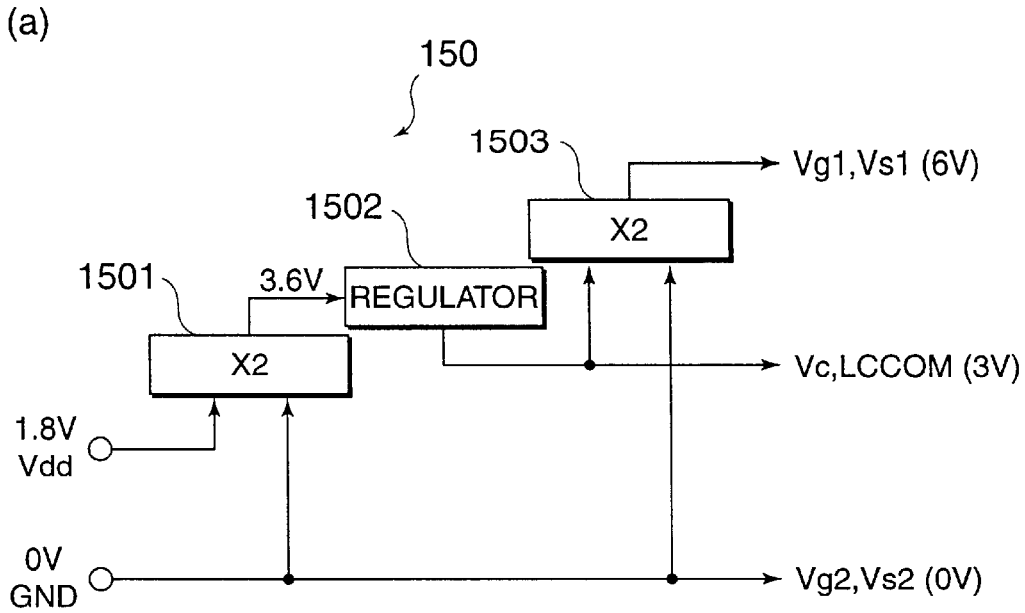
FIGS. 13(*a*) and 13(*b*) are block diagrams illustrating the structure of a driving voltage generating circuit in the electro-optical device.
Figure 13:
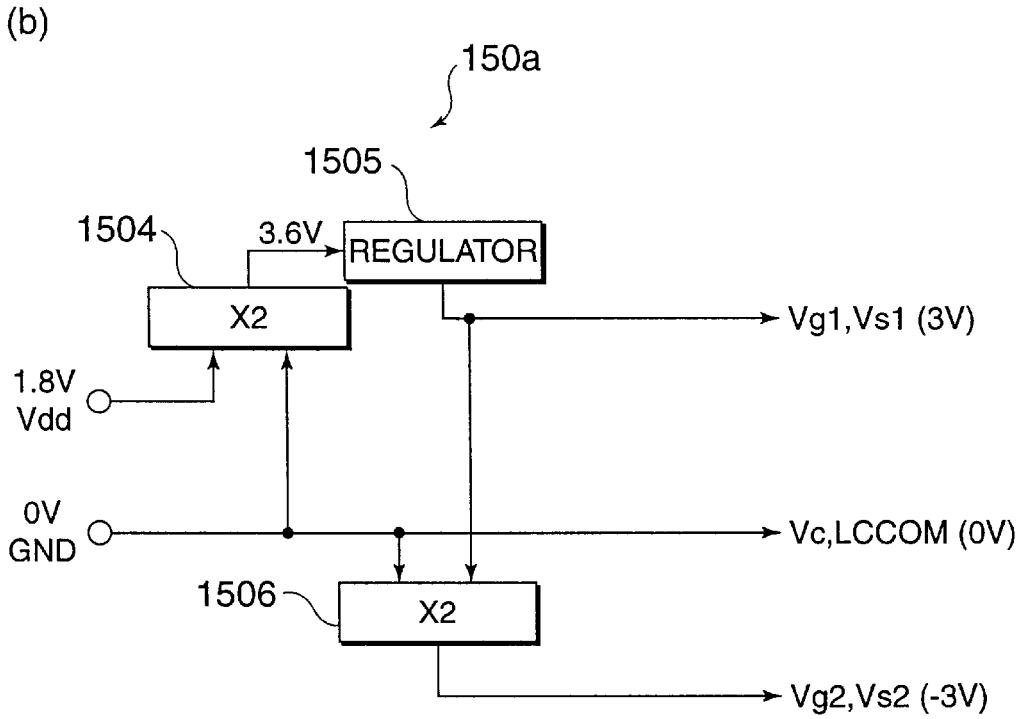

FIG. 13(*a*) is an illustration of the structure of the driving voltage generating circuit 150. As shown in the same figure, a ground potential GND and a supply voltage Vdd (=1.8 V) from a single power source (not shown) are applied to the driving voltage generating circuit 150. The driving voltage generating circuit 150 generates the above-described voltages such as by boosting the supply voltage Vdd. It should be noted that the ground potential GND is still used for the voltages Vg2 and Vs2.

As shown in FIG. 13(*a*), the driving voltage generating circuit 150 includes two times voltage boosting circuits 1501 and 1503 of the capacitive charge pump type, and a voltage regulator 1502. The two-times voltage boosting circuit 1501 is a circuit for generating a voltage (3.6 V), which is double the supply voltage Vdd, from the supply voltage Vdd. The voltage regulator 1502 generates a constant voltage of 3 V from the voltage of 3.6 V generated by the two-times voltage boosting circuit 1501. The voltage generated by the voltage regulator 1502 is output as the voltage Vc and the counter electrode voltage LCCOM. The two-times voltage boosting circuit 1503 is a circuit for generating a voltage, which is double the voltage generated by the voltage regulator 1502, from the voltage output from the voltage regulator 1502. The voltage (6 V) generated by the two-times voltage boosting circuit 1503 is output as the voltages Vg1 and Vs1.

The structure of the driving voltage generating circuit 150 is not limited to that shown in FIG. 13(*a*), but may be a structure shown in FIG. 13(*b*). When the structure shown in FIG. 13(*b*) is used, the ground potential GND is still used for the voltage Vc and the counter electrode voltage LCCOM.

In a driving voltage generating circuit 150*a* shown in FIG. 13(*b*), a voltage, which is double the supply voltage Vdd, is generated from the supply voltage Vdd by a positive two-times voltage boosting circuit 1504 of the capacitive charge pump type. A voltage regulator 1505 generates a constant voltage of 3 V from the voltage of 3.6 V generated by the two-times voltage boosting circuit 1504. The voltage generated by the voltage regulator 1505 is output as the voltages Vg1 and Vs1. On the other hand, a negative two-times voltage boosting circuit 1506 shown in FIG. 13(*b*) has the same circuit structure as that of the two-times voltage boosting circuit 1504, but it generates a negative voltage, which is double the output voltage from the voltage regulator 1505, and outputs it using that output voltage as a reference. Herein, using the ground potential GND as a reference, the negative two-times voltage boosting circuit 1506 outputs a negative voltage having the same magnitude as the output voltage from the voltage regulator 1505. The voltage generated by the negative two-times voltage boosting circuit 1506 is output as the voltages Vg2 and Vs2.

As mentioned above, the structure of the driving voltage generating circuit 150 has been described.

In the present embodiment, as shown in FIG. 11, the timing signal generating circuit 200 generates field-reverse driving signals FR1 and FR2 in place of the field-reverse driving signal FR in the first embodiment, and output them to a data line driving circuit 140*a*. The field-reverse driving signals FR1 and FR2 are signals which are level-inverted every field, similarly to the field-reverse driving signal FR in the previous embodiment, but the levels of the field-reverse driving signals FR1 and FR2 are opposite. Specifically, in the field where the field-reverse driving signal FR1 is at the H-level, the field-reverse driving signal FR2 is at the L-level, and in the field where the field-reverse driving signal FR1 is at the L-level, the field-reverse driving signal FR2 is at the H-level (see FIG. 16).

Figure 14:
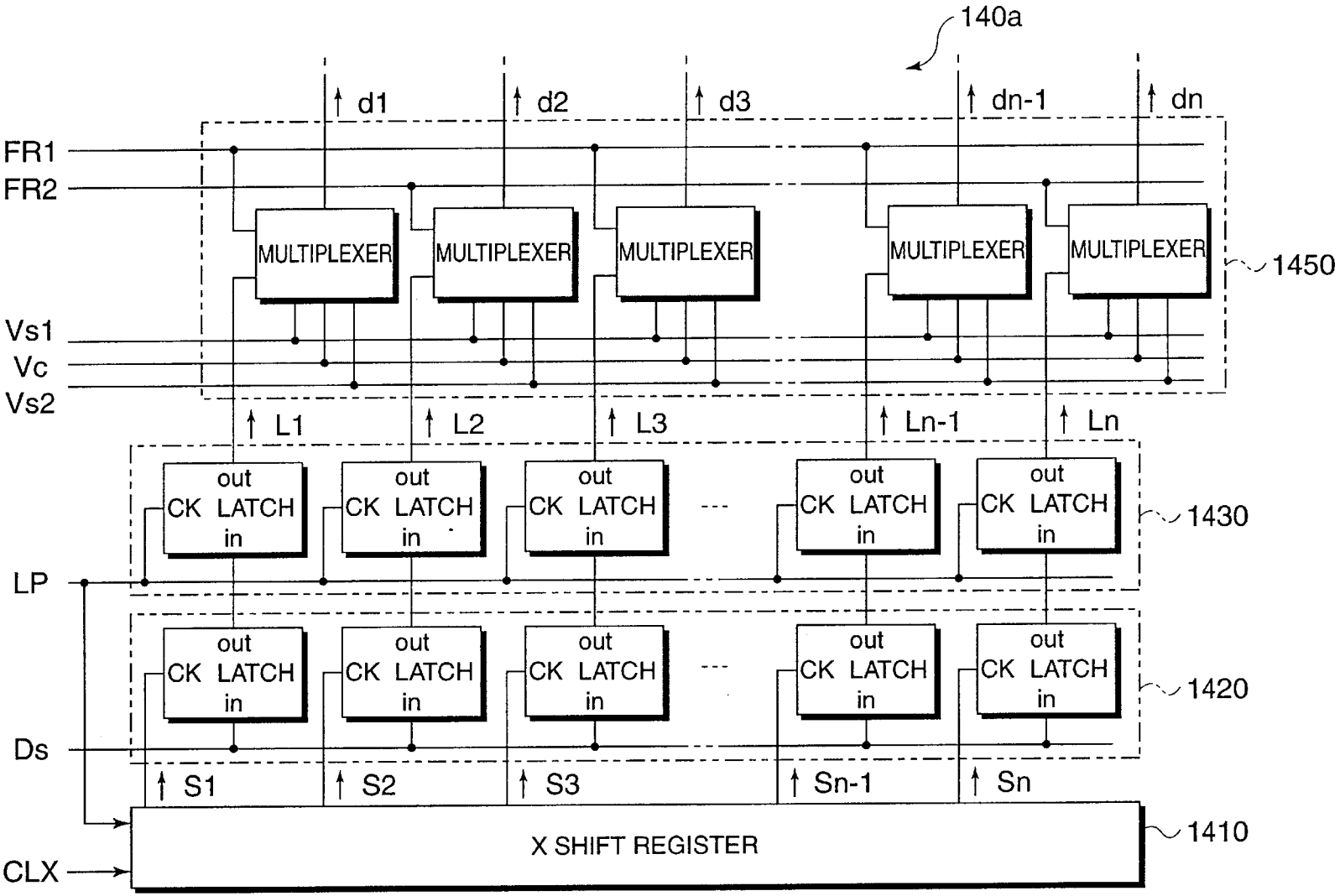
FIG. 14 is a block diagram of the structure of a data line driving circuit in the electro-optical device.

Next, FIG. 14 is a block diagram of the structure of the data signal driving circuit 140*a* in the present embodiment. As shown in the same figure, the data line driving circuit 140*a* is constituted by an X shift register 1410, a first latch circuit 1420, a second latch circuit 1430, and a multiplexer circuit 1450. The X shift register 1410, the first latch circuit 1420, and the second latch circuit 1430 are the same as those in the previous embodiment, and a description thereof is thus omitted. The multiplexer circuit 1450 selects any one of the voltages Vs1, Vs2, and Vc according to the signal L1, L2, L3, . . . , and Ln which are fed all at once from the second latch circuit 1430, and the field-reverse driving signals FR1 and FR2, and supplies data signals d1, d2, d3, . . . , and dn of the selected voltage level to the data lines 114. A specific description is as follows.

As shown in FIG. 14, in a plurality of multiplexers which constitute the multiplexer circuit 1450, the field-reverse driving signal FR1 is fed to odd columns of multiplexers from the left, and the field-reverse driving signal FR2 is fed to even columns of multiplexers from the left. The odd columns of multiplexers are connected to odd data lines 114 from the left in FIG. 11, and the even columns of multiplexers are connected to even data lines 114 from the left in FIG. 11.

The multiplexers output the data signal dj of any one of the fed voltages Vs1, Vs2, and Vc according to a truth table shown in FIG. 15. Specifically, when the signal Lj fed from the second latch circuit 1430 is at the L-level, the multiplexers of the multiplexer circuit 1450 supplies the data signal dj of the voltage Vc to the data lines 114 regardless of the level of the field-reverse driving signal FR1 or FR2. On the other hand, when the signal Lj fed from the second latch circuit 1430 is at the H-level, the multiplexers of the multiplexer circuit 1540 output the data signal dj of either the voltage Vs1 or Vs2 to the data lines 114 depending upon the level of the field-reverse driving signal FR1 or FR2. That is, as shown in FIG. 15, the data signal dj of the voltage Vs1 and the data signal dj of the voltage Vs2 are output to the data lines 114 when the field-reverse driving signal FR1 or FR2 is at the H-level and when the field-reverse driving signal FR1 or FR2 is at the L-level, respectively. As previously described, the field-reverse driving signal FR1 fed to the odd columns of multiplexers and the field-reverse driving signal FR2 fed to the even columns of multiplexers are at the level opposite to each other. Therefore, the voltage level of the data signal dj fed to the odd data lines 114 from the left and the voltage level of the data signal dj+1 fed to the even data lines 114 from the left have polarities opposite to each other using the voltage Vc as a reference.

Next, the operation according to the present embodiment is described. The overall operation of the electro-optical device according to the present embodiment is the same as that illustrated in the timing chart shown in FIG. 7, except that the field-reverse driving signal FR according to the first embodiment is replaced for the field-reverse driving signals FR1 and FR2, and the voltages applied to the pixels 110 according to the tone data are the same as those illustrated in the timing chart shown in FIG. 8. Thus, a description thereof is omitted.

Figure 16:
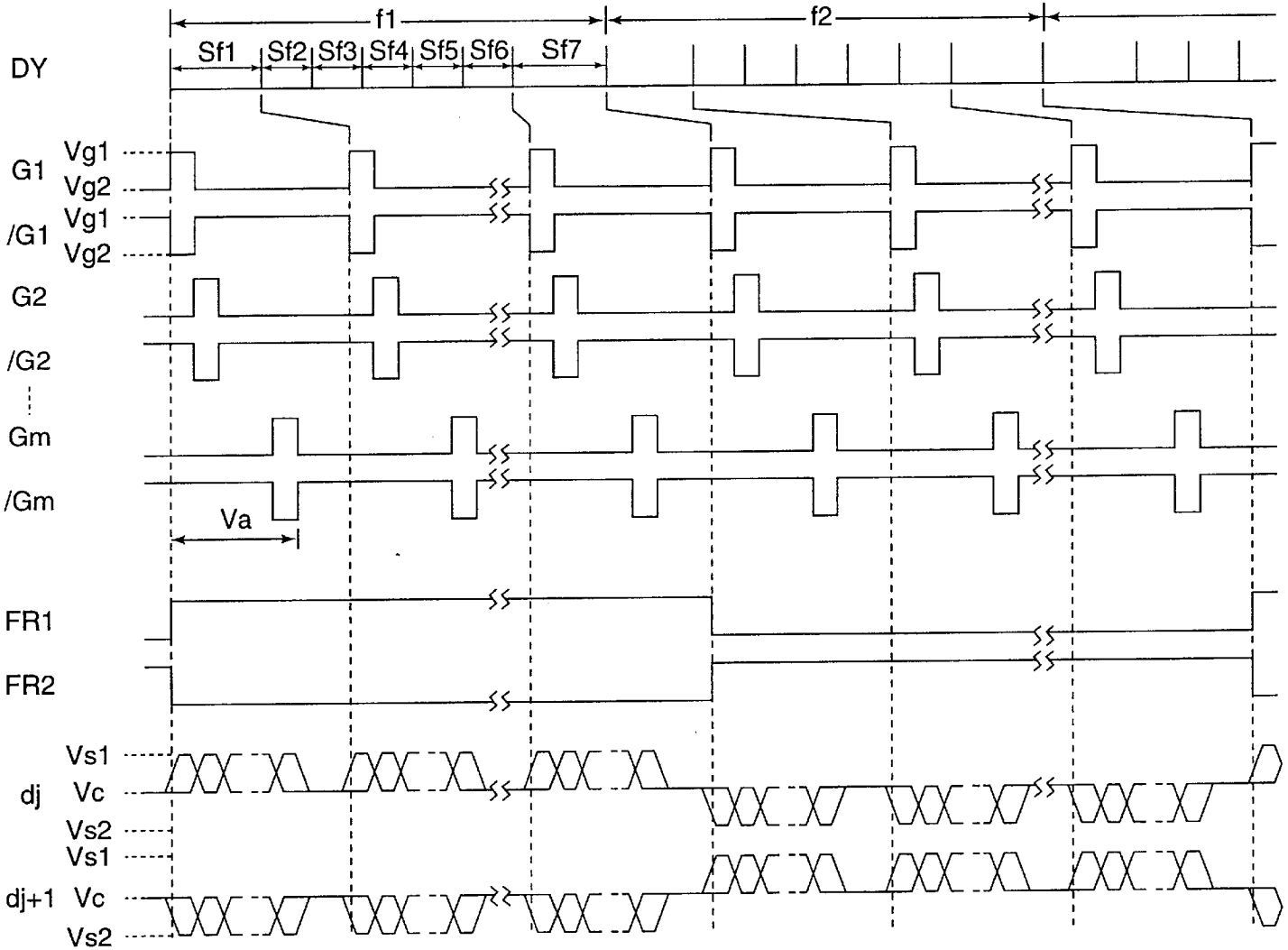
FIG. 16 is a timing chart showing the operation of the electro-optical device.

FIG. 16 is a timing chart how the start pulse DY, the scanning signal Gi, the inverted scanning signal/Gi, the field-reverse driving signals FR1 and FR2, and the data signals dj and dj+1 change. In FIG. 16, the data signal dj is a data signal fed to the odd data lines 114 from the left, and the data signal dj+1 is a data signal fed to the data lines 114 which are located on the right of these data lines, i.e., the even data lines 114 from the left. It is assumed that the field-reverse driving signal FR1 is at the H-level in the field f1 and is at the L-level in the field f2, while the field-reverse driving signal FR2 is at the L-level in the field f1 and H-level in the field f2.

As previously described, in the plurality of multiplexer of the multiplexer circuit 1450, the field-reverse driving signal FR1 is fed to the multiplexers connected to the odd data lines 114 from the left, and the field-reverse driving signal FR2 is fed to the multiplexers connected to the even data lines 114 from the left. The multiplexers operate according to the truth table shown in FIG. 15, with the result that in the field f1, the voltage level of the data signal dj fed to the odd data lines 114 is either Vs1 or Vc while the voltage level of the data signal dj+1 fed to the even data lines 114 is either Vs2 or Vc, as shown in FIG. 16. Likewise, in the field f2 where the field-reverse driving signals FR1 and FR2 are inverted, the voltage level of the data signal dj is either Vc or Vs2 while the voltage level of the data signal dj+1 is either Vs1 or Vc.

As described above, the electro-optical device according to the present embodiment achieves the same advantages as those in the previous embodiment. Furthermore, in the present embodiment, since the voltages applied to the adjacent data lines have opposite polarities, and advantageously, the power consumption can be reduced compared to the case where the voltages applied to the adjacent data lines have the same polarity, and malfunction in peripheral circuits, etc. can also be reduced, as will be described in detail hereinbelow.

First, consider that the voltage LCCOM is applied to the counter electrodes while the voltage Vs1 is applied to both pixel electrodes (a pixel electrode a and a pixel electrode b) of two adjacent pixels connected to the same scanning line, as is different from the present embodiment. In this case, electric currents instantaneously flow to the counter electrodes through capacitive components in the liquid crystal from both pixel electrode a and pixel electrode b, resulting in a problem in that the power consumption increases as a whole. Another problem occurs that a circuit for supplying the voltage LCCOM to the counter electrodes or peripheral circuits connected to the lines may more possibly produce malfunction due to influence of the electric currents which flow to the counter electrodes.

In contrast, as in the present embodiment, when the voltage Vs1 and the voltage Vs2 are applied to the pixel electrode a of one pixel and the pixel electrode b of another pixel which are adjacent to each other and which are connected to the same scanning line, respectively, the electric current which flows from the pixel electrode a to the counter electrode through the capacitive component in the liquid crystal and the electric current which flows to the pixel electrode b through the capacitive component in the liquid crystal from the counter electrode are cancelled, and as a result, substantially no electric current flows to the counter electrodes. Therefore, advantageously, the power consumed in the counter electrodes can be reduced compared with the case where the voltages having the same polarity are applied to adjacent pixels as described above. Furthermore, since substantially no electric current which can affect the peripheral circuits flows to the counter electrodes, malfunction produced in the peripheral circuits may be possibly reduced.

Similarly to the first embodiment, the counter electrode voltage LCCOM and the voltage Vc may not be necessarily the same in the present embodiment.

As mentioned above, the foregoing embodiments of the present invention have been described, but the foregoing embodiments are merely illustrative and a variety of modifications may be made without departing from the scope of the present invention. Such modifications may be contemplated by way of example as follows.

Although the field-reverse driving signal FR (in the second embodiment, FR1 and FR2) is level-inverted every field in the foregoing embodiments, it is to be understood that the cycle at which the field-reverse driving signal FR is inverted is not limited thereto. For example, the field-reverse driving signal FR (or FR1 and FR2) may be level-inverted in each sub-field, or may be level-inverted at one cycle containing more than one field. Alternatively, the field-reverse driving signal FR (or FR1 and FR2) may be level-inverted asynchronously with the above-noted signals.

Although the voltage level of the data signal fed to any of the data lines and the voltage level of the data signal fed to the data line adjacent to that data line are opposite in polarity according to the second embodiment, this is not limited. For example, a plurality of data lines are grouped into one unit, and in each of adjacent units, the voltage level of the data signal may be inverted in polarity. In other words, in pixels connected to the same scanning line, a plurality of pixels are grouped into one unit, and in each of adjacent units, the voltage level of data lines applied thereto may be inverted in polarity.

For example, although an electro-optical device capable of a color display includes a color filter for each of RGB colors in each pixel of a set of three pixels, if the data signal of the voltage Vs1 or Vc is fed to data lines contained in a certain unit, with one unit containing three data lines connected to the three pixels, the data signal of the voltage Vs2 or Vc may be fed to data lines contained in a unit adjacent to that unit.

In the above-described embodiments, writing in each of the sub-fields must be completed within a time (1 Va) equal to or shorter than the shortest sub-field. Although an eight-level tone display is assumed in the above-described embodiments, since the period of the sub-fields must be shorter in order to enhance the level of tone display, writing in each of the sub-fields must be completed in a shorter period.

However, the X shift register 1410 in a driving circuit, particularly, in the data line driving circuit 140, actually operates in the vicinity of the upper limit. This cannot enhance the level of tone display. Then, a modification which improves this point is described.

Figure 17:
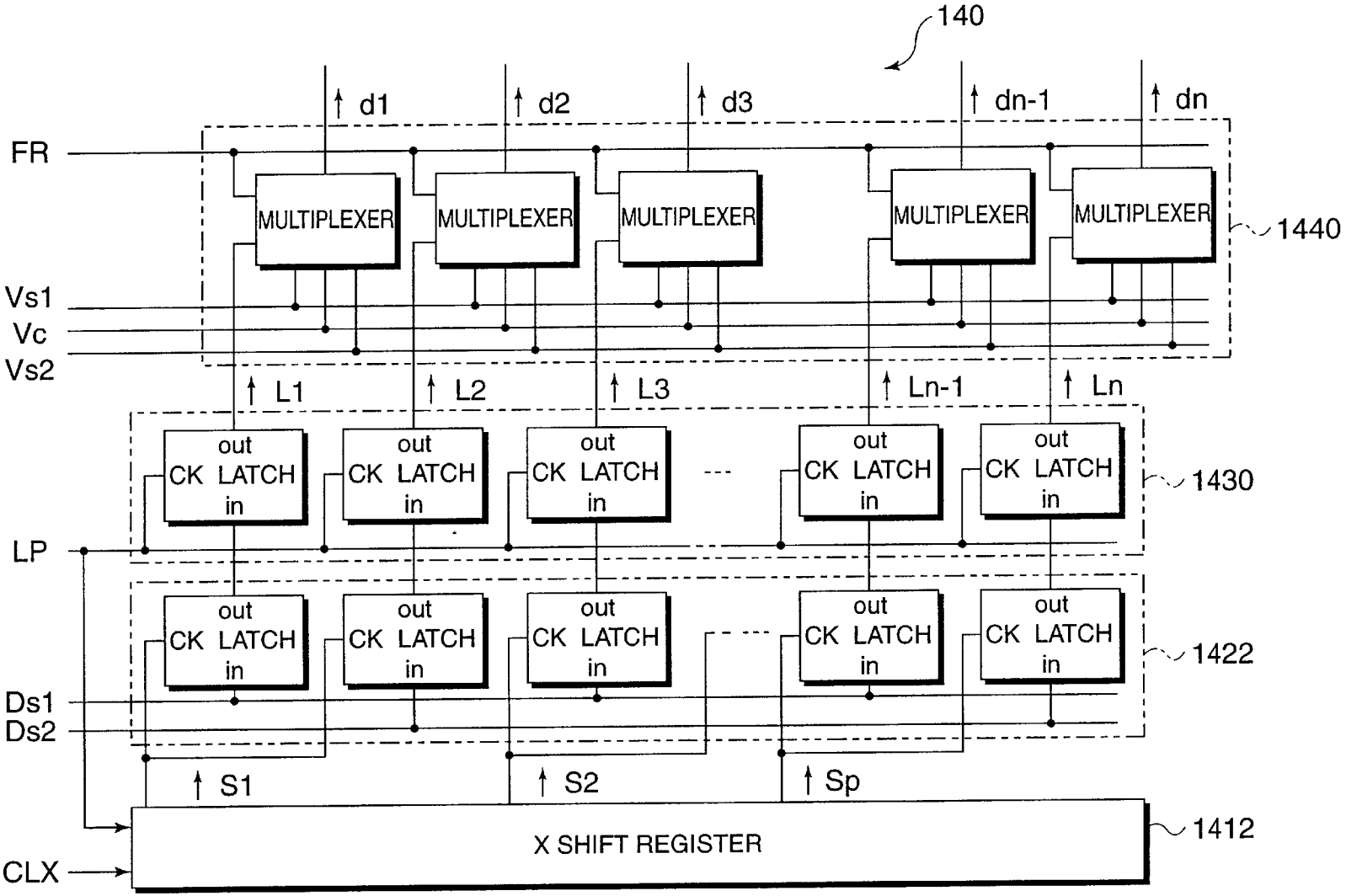
FIG. 17 is a block diagram of the structure of a data line driving circuit in an electro-optical device according to a modification of the present invention.

FIG. 17 is a block diagram of the structure of a data line driving circuit 140*b* in an electro-optical device according to this modification. In this figure, an X shift register 1412 is the same as the X shift register 1410 shown in FIG. 4 in that it transfers the latch pulse LP according to the clock signal CLX, but is different from the X shift register 1410 in that its stages are reduced by half. Specifically, assuming that an integer p satisfies n=2p, the X shift register 1412 is so arranged as to sequentially output latch signals S1, S2, S3, . . . , and Sp.

In this modification, binary signals are distributed into two types of binary signals Ds1 to odd data line 114, and binary signals Ds2 to even data line 114 from the left. A first latch circuit 1422 contains sets of one for latching a binary signal Ds1 corresponding to an odd data line 114 and one for latching a binary signal Ds2 corresponding to an even data line 114 so that the latching operations are concurrently performed at the falling edge of the same latch signal.

Accordingly, in such a data line driving circuit 140*b*, as shown in FIG. 17, the same latch signals S1, S2, S3, . . . may be used to latch the binary signals Ds1 and Ds2 corresponding to two pixels at the same time. Hence, while the frequency of the clock signal CLX is maintained the same as in the previous embodiments, the required horizontal scanning period can be reduced by half. Furthermore, the number of unit circuit stages which constitute the X shift register 1412 is reduced from "n" corresponding to a total of data lines 114 to "p" which is half. Therefore, the structure of the X shift register 1412 can be simplified compared to the X shift register 1410 (see FIG. 4).

On the other hand, the fact that the number of unit circuit stages which constitute the X shift register 1411 can be reduced by half means that the frequency of the clock signal CLX can be reduced by half if the required horizontal scanning period is the same. Therefore, if the horizontal scanning period is the same, the power consumption which results from the operational frequency can be reduced.

Although the number of circuits in the latch circuit 1421 which concurrently perform the latching operations in response to a latch signal is "2" it is to be understood that the number may be of course "3" or more. In this case, the binary signals are distributed into types corresponding to the number of circuits, and the number of stages in the X shift register 1411 can be reduced to the number obtained by dividing the number of data lines by the number of circuits.

The data transfer period (1 Va) shown in FIGS. 7 and 16 is a time until a data signal has been written to all pixels on one screen. In other words, it can be said that the data transfer period (1 Va) is a period from when the scanning signal G1 is fed to a first scanning line from the top until the scanning signal Gm has been fed to the scanning line at the bottom (an m-th scanning line from the top). When the time length of the data transfer period (1 Va) is shorter than the time length of each sub-field, there is a period from when a data signal has been written to all pixels on one screen until a new data signal is written in the next sub-field. During this period, there is no need to write the data signal into pixels, and the level of the clock signal CLX fed to the X shift register in the data line driving circuit may not be changed. By doing so, the power consumption can be further reduced.

Figure 18:
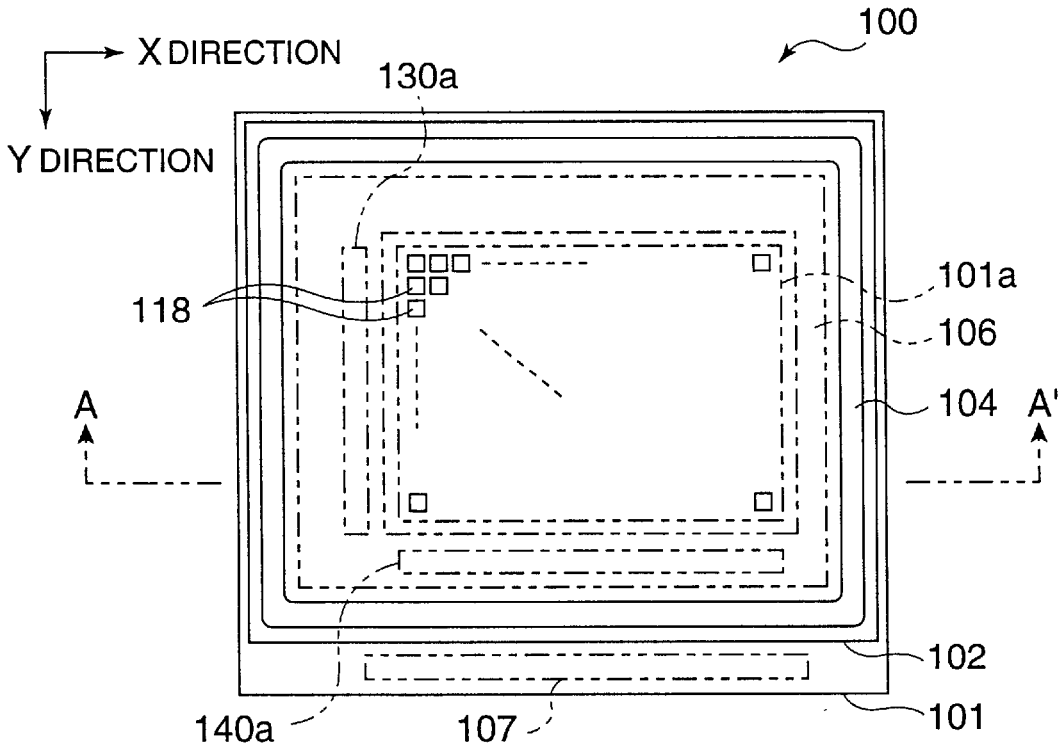
FIG. 18 is a plan view of the structure of the electro-optical device.
Figure 19:
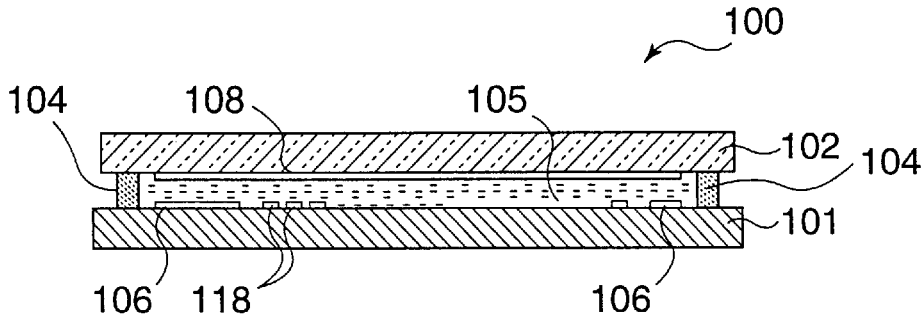
FIG. 19 is a cross-sectional view of the structure of the electro-optical device.

Next, the structure of the electro-optical device according to the previous embodiments and modifications as described above is described with reference to FIGS. 18 and 19. FIG. 18 is a plan view showing the structure of an electro-optical device 100, and FIG. 19 is a cross-sectional view of that taken along line A–A' of FIG. 18.

As shown in these figures, the electro-optical device 100 can include an element substrate 101 on which pixel electrodes 118, etc., are formed, and an opposing substrate 102 on which counter electrodes 108, etc. are formed, which are bonded at a constant spacing therebetween by a seal member 104 such that a liquid crystal 105 (for example, twisted nematic type) as an electro-optical material is interposed in the spacing. It is to be understood that the liquid crystal material is not limited to the TN, and a variety of liquid crystals such as various nematic liquid crystals, such as super twisted nematic (STN) liquid crystal, vertical orientation type liquid crystal, and non-twisted horizontal orientation type liquid crystal, polymer dispersed liquid crystal, ferroelectric liquid crystal, and bi-stable TN (bi-stable twisted nematic) liquid crystal may be used. In practice, the seal member 104 has a cutout through which the liquid crystal 105 is encapsulated and is then sealed by a sealant, but this is omitted in these figures.

In the foregoing embodiments, the element substrate 101 is a transparent substrate made of glass, quartz, of the like, as described above. Therefore, by forming the pixel electrodes 118 of reflective metal such as aluminum, it can be used as a reflection type display, while by forming the pixel electrodes 118 of transparent thin films made of ITO (indium tin oxide) or the like, it can be used as a transmission type display.

Accordingly, in the foregoing embodiments, the element substrate 101 is a transparent insulating substrate made of glass, quartz, or the like, and the transistors 116 connected to the pixel electrodes 118, components of the driving circuit, etc. are formed by TFTs formed on a semiconductor thin film deposited or bonded onto the substrate. However, the implementation of the present invention is not limited to such an electro-optical device. For example, the element substrate 101 may be a semiconductor substrate such that MOS field effect transistors (MOSFETs) etc. may be formed on this semiconductor substrate. In this case, however, the element substrate is not transparent, and the pixel electrodes 118 are formed of reflective metal such as aluminum, thereby providing a reflection type display. If it is a transparent substrate, a reflection type display may be obtained such that the pixel electrodes are made reflection electrodes, or a reflective film or a reflector is arranged on an inner or outer plane of the substrate.

A light-shielding film 106 is formed in a region on the element substrate 101 which is inside the seal member 104 and outside the display region 101*a*. In the region where the light-shielding film 106 is formed, the scanning line driving circuit 130 is formed in a region 130*a*, and the data line driving circuit 140 is formed in a region 140*a*. That is, the light-shielding film 106 prevents light from entering the driving circuits formed on these regions. It is so arranged that, together with the counter electrodes 108, the field-reverse driving signal LCCOM is applied to the light-shielding film 106. Hence, in the region where the light-shielding film 106 is formed, the voltage applied to the liquid crystal layer is substantially zero, resulting in the same display state as when no voltage is applied to the pixel electrodes 118.

In a region 107 on the element substrate 101 which is outside the region 104*a* where the data line driving circuit 140 is further formed and which is spaced apart from the seal member 104, a plurality of connection terminals are formed through which control signals from the outside, the power supply, etc. are input.

On the other hand, the counter electrodes 108 on the opposing substrate 102 is electrically connected to the light-shielding film 106 and the connection terminals on the element substrate 101 by a conductor (not shown) disposed at at least one location of four corners at which the substrates are bonded. That is, the counter electrode voltage LCCOM is applied to the light-shielding film 106 via the connection terminals formed on the element substrate 101, and is applied to the counter electrodes 108 via the conductor.

Alternatively, the counter substrate 102 may include, first, color filters which are arranged into stripe, mosaic, or triangle according to the purpose of the electro-optical device 100, for example, if it is of the direct viewing type, and, second, a light-shielding film (block matrix) made of, for example, metallic material, resin, or the like. For the purpose of chromatic modulation, for example, if it is used as a light bulb of a projector as will be described, no color filter is formed. If it is of the direct viewing type, a front light for illuminating the electro-optical device 100 from the opposing substrate 102 side is provided, if necessary. In addition, oriented films (not shown) which have been rubbed in a predetermined direction, and the like are formed on the planes where the electrodes are formed on the element substrate 101 and the opposing substrate 102, so that the orientation of the liquid crystal molecules is defined while no voltage is applied, while a polarizer (not shown) is formed on the opposing substrate 101 side according to the orientation. However, when a polymer dispersed liquid crystal in which molecules are dispersed in a polymer is used as the liquid crystal 105, the above-noted oriented films or polarizer may not be required, and as a result, the efficiency for light utilization is enhanced. This is advantageous in view of high brightness or reduced power consumption.

In addition to the liquid crystal, the electro-optical material may include an electroluminescence (EL) to provide a display device by virtue of its electro-optical effects. Therefore, the present invention can be applied to an electro-optical device having a structure similar to the above-described structure, in particular, to all of the electro-optical devices which use pixels for achieving a binary display of ON/OFF to provide a tone display. Some electro-optical devices, such as EL panel, are not formed by a pair of substrates, as in a liquid crystal panel, but are so arranged that switching elements of pixels, pixel electrodes and counter electrodes, and EL interposed therebetween as an electro-optical material are together formed on a single substrate. Therefore, the electro-optical device according to the present invention is not limited to that having a pair of substrates.

Next, some specific examples in which the foregoing liquid crystal device is incorporated in electronic equipment are described.

Figure 20:
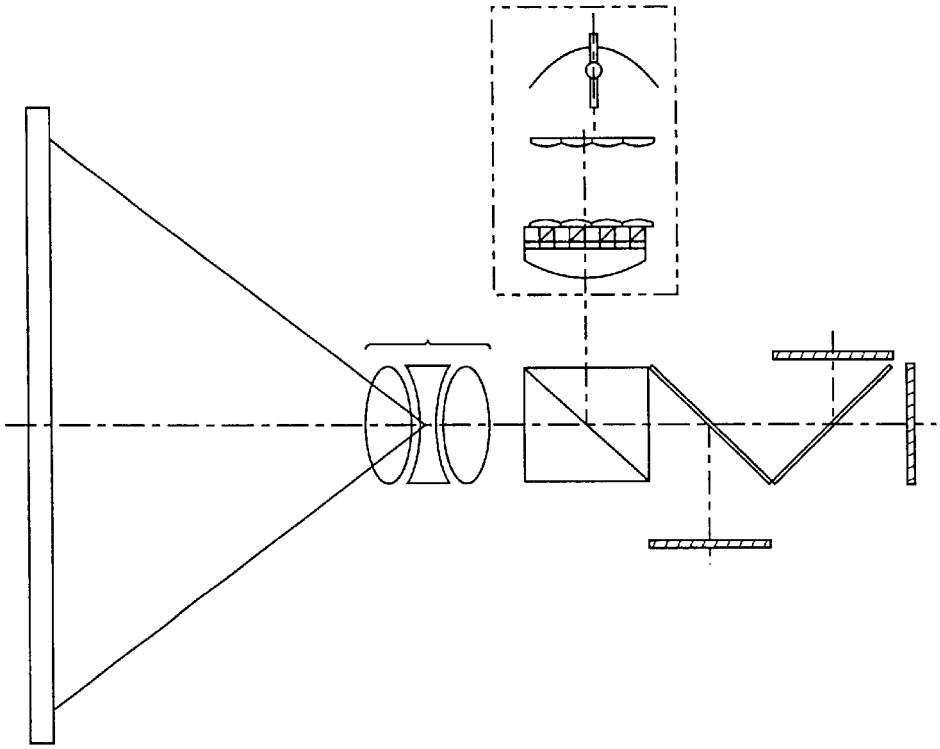
FIG. 20 is a cross-sectional view of the structure of a projector which is an example of electronic equipment to which the electro-optical device is applied.

A projector using the electro-optical device according to the embodiments as a light bulb is described. FIG. 20 is a plan view of the structure of the projector. As shown, a polarizing illumination device 1110 is disposed along the system optical axis PL in a projector 1110. In the polarizing illumination device 1110, the light emitted from a lamp 1112 is reflected by a reflector 1114 to be a substantially collimated flux to enter a first integrator lens 1120. The light emitted from the lamp 1112 is then divided into a plurality of intermediate fluxes. The divided intermediate fluxes are converted by a polarizing conversion element 1130, having a second integrator lens at the incident light side, into one kind of polarized fluxes (s polarized fluxes) having polarizing directions substantially aligned, which are then emitted from the polarizing illumination device 1110.

The s polarized fluxes emitted from the polarizing illumination device 11110 are reflected by an s polarized flux reflection plane 1141 of a polarizing beam splitter 1140. A blue (B) flux of the reflected fluxes is reflected by a blue light reflection layer of a dichroic mirror 1111, and is modulated by a reflection type electro-optical device 100B. A red (R) flux of the light fluxes which transmit the blue light reflection layer of the dichroic mirror 1151 is reflected by a red light reflection layer of a dichroic mirror 1152, and is modulated by a reflection type electro-optical device 100R. A green (G) flux of the light fluxes which transmit the blue light reflection layer of the dichroic 1151 transmits the red light reflection layer of the dichroic mirror 1152, and is modulated by a reflection type electro-optical device 100G.

The red, green and blue lights which are thus chromatically modulated by the electro-optical devices 100R, 100G, and 100B, respectively, are sequentially combined by the dichroic mirrors 1152 and 1151, and the polarizing beam splitter 1140, and are then projected by a projecting optical system 1160 onto a screen 1170. Since the light fluxes for the original R, G, and B colors are incident on electro-optical devices 100R, 100B, and 100G through the dichroic mirrors 1151 and 1152, no color filter is required.

Figure 21:
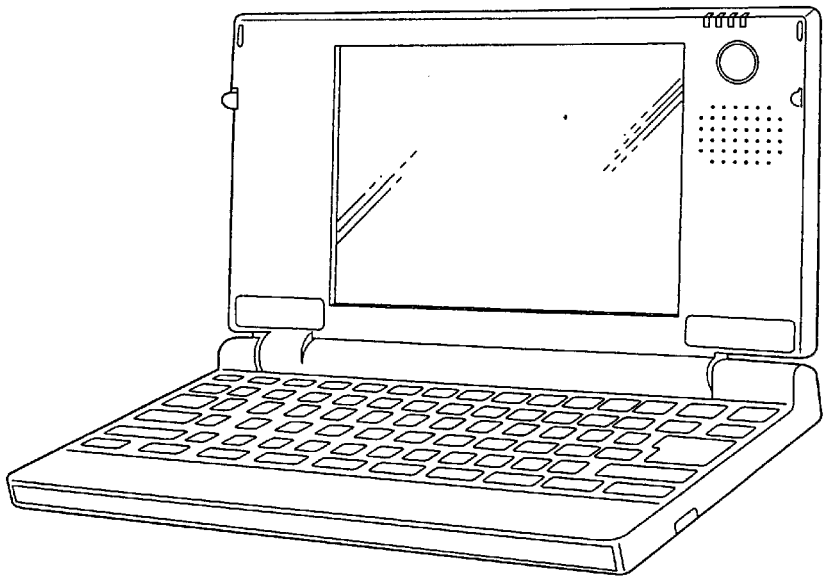
FIG. 21 is a perspective view of the structure of a personal computer which is an example of electronic equipment to which the electro-optical device is applied.

Next, an example in which the above-described electro-optical device is applied to a mobile personal computer is described. FIG. 21 is a perspective view of the structure of the personal computer. In the figure, a computer 1200 includes a main body 1204 having a keyboard 1202, and a display unit 1206. The display unit 1206 is so arranged that a front light is provided on a front portion of the previously described electro-optical device 100.

In this structure, since the electro-optical device 100 is used as a reflection direct-viewing type device, preferably, the pixel electrodes 118 form irregularity so as to scatter the reflected light in different directions.

Figure 22:
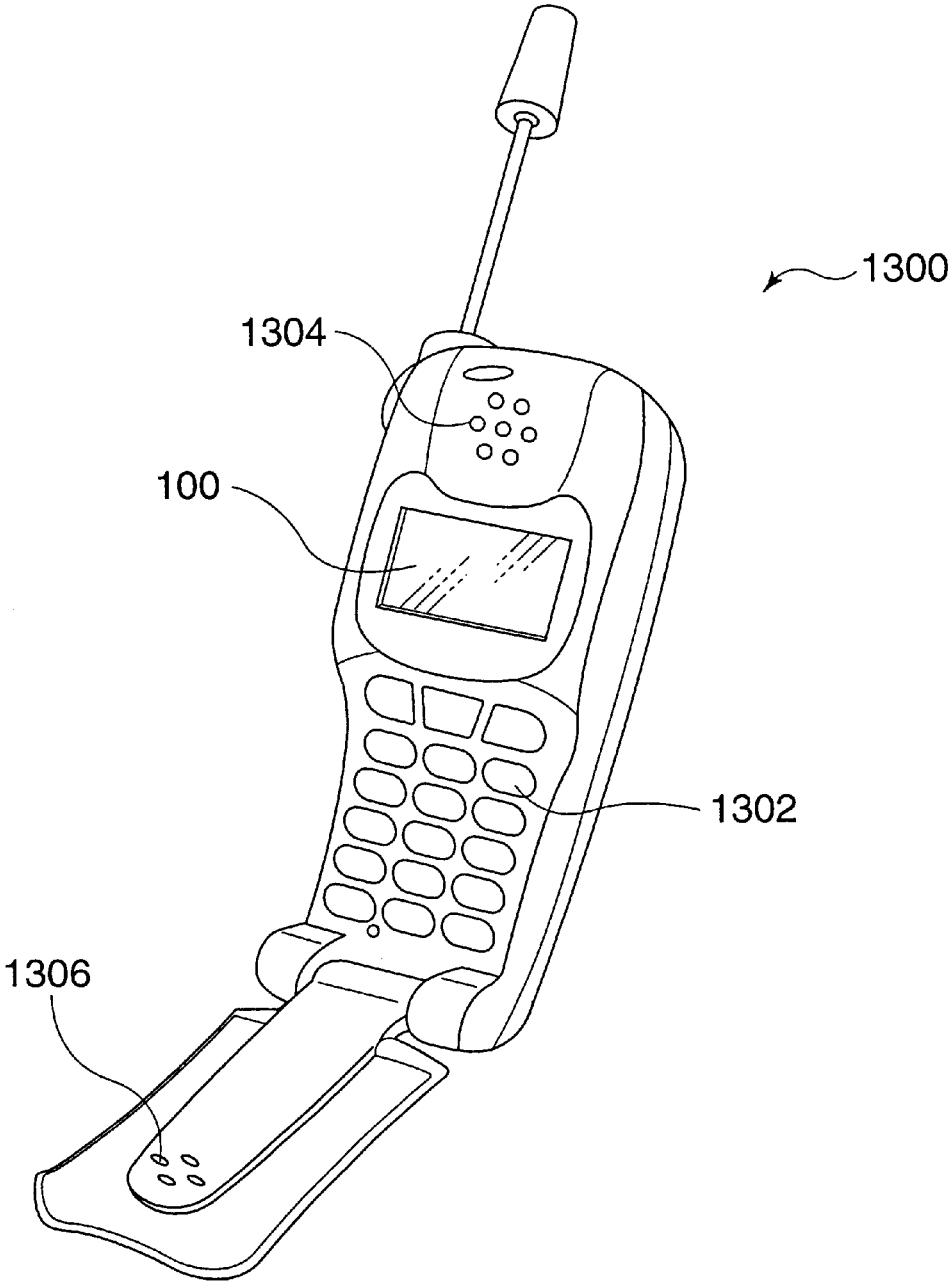
FIG. 22 is a perspective view of the structure of a cellular telephone device which is an example of electronic equipment to which the electro-optical device is applied.

A further example in which the above-described electro-optical device is applied to a cellular telephone is described. FIG. 22 is a perspective view of the structure of the cellular telephone. In the figure, a cellular telephone 1300 includes a plurality of operational buttons 1302, an earpiece 1304, a mouthpiece 1306, and an electro-optical device 100. The electro-optical device 100 also has a front light on its front portion, if necessary. Also in this structure, since the electro-optical device 100 is used as a reflection direct-viewing type device, preferably, the pixel electrodes 118 form irregularity.

Besides those described with reference to FIGS. 20 to 22, the electronic equipment may include a liquid crystal television set, a view-finder type or monitor direct-viewing type video tape recorder, a car navigation apparatus, a pager, an electronic organizer, a calculator, a word processor, a workstation, a television telephone, a POS terminal, a device having a touch panel and the like. It is to be understood that the electro-optical device according to the embodiments and modifications can be applied to various kinds of electronic equipment as mentioned above without departing from the spirit and scope of the present invention.

As described above, according to the present invention, three kinds of voltages are selected based on a binary signal to provide a data signal, and a high-quality tone display is thus achieved. The present invention is also advantageous in that an application of DC component to the liquid crystal layer can be avoided while uniformity of the effective voltages applied to the pixels cannot be impaired over all of the pixels.

While this invention has been described in conjunction with specific embodiments thereof, it is evident that many alternatives, modifications, and variations will be apparent to those skilled in the art. Accordingly, preferred embodiments of the invention as set forth herein are intended to be illustrative not limiting. Various changes may be made without departing from the spirit and scope of the invention.

What is claimed is:

1. A driving circuit of a liquid crystal device for driving a plurality of pixels, having pixel electrodes, a counter electrode opposing the pixel electrodes and to which a constant reference voltage is applied, so as to be turned on or off according to tone data, and a liquid crystal interposed between the pixel electrodes and the counter electrode, the pixels being disposed at intersections between a plurality of data lines and a plurality of scanning lines, said driving circuit comprising:

a data converting circuit that generates a binary signal indicating that a given pixel is turned on or off in each of a plurality of sub-fields divided from each field corresponding to a non-linear relationship between an effective voltage applied to the liquid crystal and a relative transmittance or reflectance, a period of each sub-field relative to one field being set to achieve the effective voltage corresponding to the tone data, the data converting circuit generating the binary signal from the tone data in each sub-field per pixel so that the proportion of the period during which the pixel is turned on to the period during which the pixel is turned off within one field corresponds to the proportion according to the tone data; and a data line driving circuit that applies a voltage to turn on or off the pixel to the data lines according to the binary signal from said data converting circuit, and, when the pixel is turned on, switches any one of a first voltage which is higher than the constant reference voltage and a second voltage which is lower than the constant reference voltage at a predetermined time interval to apply it to the data line to which the pixel is connected;

each of the plurality of scanning lines includes a first scanning line and a second scanning line, said driving circuit further comprising a scanning line driving circuit for supplying a first scanning signal to the first scanning line and a second scanning signal, having a signal polarity opposite to the first scanning signal, to the second scanning line, the pixels being connected to the data lines via complementary switching elements connected to the first scanning line and the second scanning line; and the voltage level at which the first scanning signal allows the switching element connected to the first scanning line to be turned on and the voltage level of the first voltage are the same, and the voltage level at which the second scanning signal allows the switching element connected to the second scanning line to be turned on and the voltage level of the second voltage are the same.

2. The driving circuit according to claim 1, wherein said data line driving circuit applies the first voltage and the second voltage via the data lines to a first pixel and a second pixel, respectively, which are adjacent to each other and which are connected to the same scanning line, as voltages to turn on the pixels.

3. A liquid crystal device, comprising:

a plurality of pixels having pixel electrodes, which are disposed at intersections between a plurality of data lines and a plurality of scanning lines;

a counter electrode opposing the pixel electrodes and to which a constant reference voltage is applied;

a liquid crystal interposed between the pixel electrodes and the counter electrode;

a data converting circuit that generates a binary signal indicating to apply either voltage to turn on or off a given pixel in each of a plurality of sub-fields divided from each field corresponding to a non-linear relationship between an effective voltage applied to the liquid crystal and a relative transmittance or reflectance, a period of each sub-field relative to the one field being set to achieve the effective voltage corresponding to the tone data, the data converting circuit generates the binary signal from tone data in each sub-field per pixel so that the proportion of the period during which the pixel is turned on to the period during which the pixel is turned off within one field corresponds to a proportion according to the tone data; and a data line driving circuit that applies a voltage to turn on or off the pixel to the data lines according to the binary signal from said data converting circuit, and, when a pixel is turned on, the data line driving circuit further switches any one of a first voltage which is higher than the constant reference voltage and a second voltage which is lower than the constant reference voltage at a predetermined time interval to apply it to the data line to which the pixel is connected;

each of the plurality of scanning lines includes a first scanning line and a second scanning line, the liquid crystal device further comprising a scanning line driving circuit that supplies a first scanning signal to the first scanning line and a second scanning signal, having a signal polarity opposite to the first scanning signal, to the second scanning line, the pixels being connected to the data lines via complementary switching elements connected to the first scanning line and the second scanning line; and the voltage level at which the first scanning signal allows the switching element connected to the first scanning line to be turned on and the voltage level of the first voltage are the same, and the voltage level at which the second scanning signal allows the switching element connected to the second scanning line to be turned on and the voltage level of the second voltage are the same.

4. The electro-optical device according to claim 3, wherein said data line driving circuit applies the first voltage and the second voltage via the data lines to a first pixel and a second pixel, respectively, which are adjacent to each other and which are connected to the same scanning line, as voltages to turn on the pixels.

5. Electronic equipment comprising an electro-optical device according to claim 3.

* * * * *